US011635722B2

(12) United States Patent
Kawamura et al.

(10) Patent No.: US 11,635,722 B2
(45) Date of Patent: Apr. 25, 2023

(54) DRIVING FORCE TRANSMITTING DEVICE, SHEET FEEDING APPARATUS AND IMAGE FORMING APPARATUS

(71) Applicant: CANON KABUSHIKI KAISHA, Tokyo (JP)

(72) Inventors: Koji Kawamura, Yokohama (JP); Seiji Hara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 541 days.

(21) Appl. No.: 16/163,724

(22) Filed: Oct. 18, 2018

(65) Prior Publication Data

US 2019/0121278 A1 Apr. 25, 2019

(30) Foreign Application Priority Data

Oct. 20, 2017 (JP) ..... JP2017-203069
Jul. 11, 2018 (JP) ..... JP2018-131618

(51) Int. Cl.
*G03G 15/00* (2006.01)
*B65H 3/06* (2006.01)

(52) U.S. Cl.
CPC ..... *G03G 15/6502* (2013.01); *B65H 3/0669* (2013.01); *B65H 2403/421* (2013.01);
(Continued)

(58) Field of Classification Search
CPC ..... G03G 15/6502; B65H 3/0668; B65H 2403/421; B65H 2403/484; B65H 2403/512; B65H 2403/53; B65H 2403/80
(Continued)

(56) References Cited

U.S. PATENT DOCUMENTS

2010/0104311 A1* 4/2010 Okamoto ..... G03G 15/6502 399/75
2014/0140745 A1* 5/2014 Choi ..... G03G 15/757 399/381
(Continued)

FOREIGN PATENT DOCUMENTS

JP S61-141853 U 9/1986
JP H06-50406 2/1994
(Continued)

OTHER PUBLICATIONS

"Design, Applications, Advantages, and Manufacturing of the Involute Gear" by Suvo as downloaded by the Internet Archive Wayback Machine on Mar. 23, 2015.*
(Continued)

*Primary Examiner* — Justin N Olamit
(74) *Attorney, Agent, or Firm* — Venable LLP

(57) ABSTRACT

A drive transmitting device includes a first gear; a second gear in engagement with the first gear; wherein a first tooth which is at least one of teeth of the first gear has a tooth surface contacting a tooth of the second gear, wherein the tooth surface has such a shape that a contact point of the first tooth of the first gear to the tooth of the second gear is in a region of a first gear side with respect to a line of action which is formed by movement of a contact point between a tooth of the second gear and a second tooth of the first gear immediately before the first tooth with respect to a rotational moving direction of the first gear.

12 Claims, 24 Drawing Sheets

(52) U.S. Cl.
CPC .. *B65H 2403/484* (2013.01); *B65H 2403/512* (2013.01); *B65H 2403/53* (2013.01); *B65H 2403/80* (2013.01)

(58) Field of Classification Search
USPC ..... 399/388
See application file for complete search history.

(56) References Cited

U.S. PATENT DOCUMENTS

| | | | | |
|---|---|---|---|---|
| 2016/0264367 | A1* | 9/2016 | Mizuguchi | B65H 1/266 |
| 2017/0248171 | A1 | 8/2017 | Kawamura et al. | |
| 2017/0248211 | A1 | 8/2017 | Chino | |
| 2017/0371288 | A1* | 12/2017 | Hashimoto | B65H 85/00 |
| 2018/0180106 | A1 | 6/2018 | Hara | |

FOREIGN PATENT DOCUMENTS

| | | | | |
|---|---|---|---|---|
| JP | H08-226517 | | | 9/1996 |
| JP | H11-11709 | | | 1/1999 |
| JP | H11-283305 | | | 10/1999 |
| JP | 2002-265076 | | | 9/2002 |
| JP | 3786541 | B2 | | 6/2006 |
| JP | 2009300858 | A | * | 12/2009 |
| JP | 2017-030910 | | | 2/2017 |
| JP | 2017150619 | A | | 8/2017 |
| JP | 2018-017299 | | | 2/2018 |

OTHER PUBLICATIONS

Office Action dated May 31, 2022 in counterpart Japanese Application No. 2018-131618, together with English translation thereof.

* cited by examiner (a)

(b)

(a)

(b)

DRIVING FORCE TRANSMITTING DEVICE, SHEET FEEDING APPARATUS AND IMAGE FORMING APPARATUS

FIELD OF THE INVENTION AND RELATED ART

The present invention relates to a driving force transmitting device, a sheet feeding apparatus which employs a driving force transmitting device, and an image forming apparatus.

Referring to FIG. 13, the sheets S stored in layers in a sheet feeding tray 51 remain pressured against a feed roller 52 by a lifting mechanism (unshown). A sheet feeding apparatus is provided with a separation pad 53, which is positioned in a manner to oppose the feed roller 52. The separation pad 53 is kept pressed against the feed roller 52 by the pressure generated by a pair of compression springs 54. As the feed roller 52 rotates in response to a feed signal from the control portion of an image forming apparatus, the top sheet S1 of the multiple sheets S in the sheet feeder tray 51 is separated from the rest by the separation pad 53. Then, it is sent to a pair of conveyance rollers 56 and 57 along a conveyance guide 55. The pair of conveyance rollers 56 and 57 are positioned on the top side of the sheet feeder tray 51. The conveyance guide 55 is formed and positioned so that it curves upward. Therefore, as the sheet S1 is fed into the main assembly of the image forming apparatus by the feed roller 52, it slackens between the feed roller 52 and the pair of conveyance rollers 56 and 57, by the time its leading edge reaches the pair of conveyance rollers 56 and 57.

In order to prevent a sheet feeding apparatus such as the one described above from feeding two or more sheets S into the main assembly of an image forming apparatus, the sheet feeding apparatus is controlled so that the driving of the feed roller 52 is stopped before the training end of the sheet S1 passes by the feed roller 52.

In a case where the feed roller 52 and pair of conveyance rollers 56 and 57 are equal in conveyance speed, the sheet S1 is suddenly tensioned between the feed roller 52 and the pair of conveyance rollers 56 and 57 by the load from the separation pad 53, immediately after the driving of the feed roller 52 is stopped. This is problematic in that as the sheet S1 is suddenly tensioned, it generates a substantial amount of "tensioning" noise.

There have been made various attempts to prevent the occurrence of this tensioning noise. In the case of the sheet feeding apparatus disclosed in Japanese Patent No. 3786541, the relationship between a speed Vf at which a sheet S is conveyed by the feed roller 52 and a speed Vt at which a sheet S is conveyed by the pair of conveyance rollers 56 and 57 were set so that the former is smaller than the latter: $Vf<Vt$. By setting the two speeds as described above, it was possible to eliminate the slackening of the sheet S1 caused by the difference in speed between the feed roller 52 and the pair of conveyance rollers 56 and 57, by the time the driving of the feed roller 52 is stopped.

With the relationship in rotational speed between the feed roller 52 and the pair of conveyance rollers 56 and 57 being set as described above, the sheet S1 was tensioned before the driving of the feed roller 52 was stopped. Therefore, it did not occur that as the driving of the feed roller 52 is stopped, a substantial amount of tensioning noise is caused by the tensioning of the sheet S1.

Further, there is disclosed in Japanese Laid-open Patent Application No. 2017-150619, a driving force transmitting device which intermittently transmits driving force.

By the way, provided that printing speed (number of prints which can be outputted per minute) remains constant, the smaller the sheet interval (distance between consecutively conveyed two sheets), the lower the motor can be set in revolution, and therefore, the lower the image forming apparatus in energy consumption. In recent years, it has been desired to reduce sheet interval as much as possible, from the standpoint of energy conservation.

By the way, in the case of a conventional sheet feeding apparatus, the relationship in conveyance speed between the feed roller 52 and the pair of conveyance rollers 56 and 57 is set to be: $Vf<Vt$. Therefore, unlike in the case of a sheet feeding apparatus set so that $Vf=Vt$, the sheet interval increases by the time the sheet S reaches the pair of conveyance rollers 56 and 57. In other words, a conventional sheet feeding apparatus is disadvantageous in terms of control, from the standpoint of energy conservation.

SUMMARY OF THE INVENTION

Thus, the primary object of the present invention is to provide a sheet feeding apparatus which does not cause a sheet of recording medium to generate a substantial amount of "tensioning" noise as it is tensioned by the stopping of the driving of the feed roller of the sheet feeding apparatus, and which is no greater in energy consumption than any conventional sheet feeding apparatus.

According to an aspect of the present invention, there is provided a drive transmitting device comprising a first gear; a second gear in engagement with said first gear; wherein a first tooth which is at least one of teeth of said first gear has a tooth surface contacting a tooth of said second gear, wherein said tooth surface has such a shape that a contact point of said first tooth of said first gear to the tooth of said second gear is in a region of a first gear side with respect to a line of action which is formed by movement of a contact point between a tooth of said second gear and a second tooth of said first gear immediately before the first tooth with respect to a rotational moving direction of said first gear.

Further features of the present invention will become apparent from the following description of exemplary embodiments with reference to the attached drawings.

Figure 3:
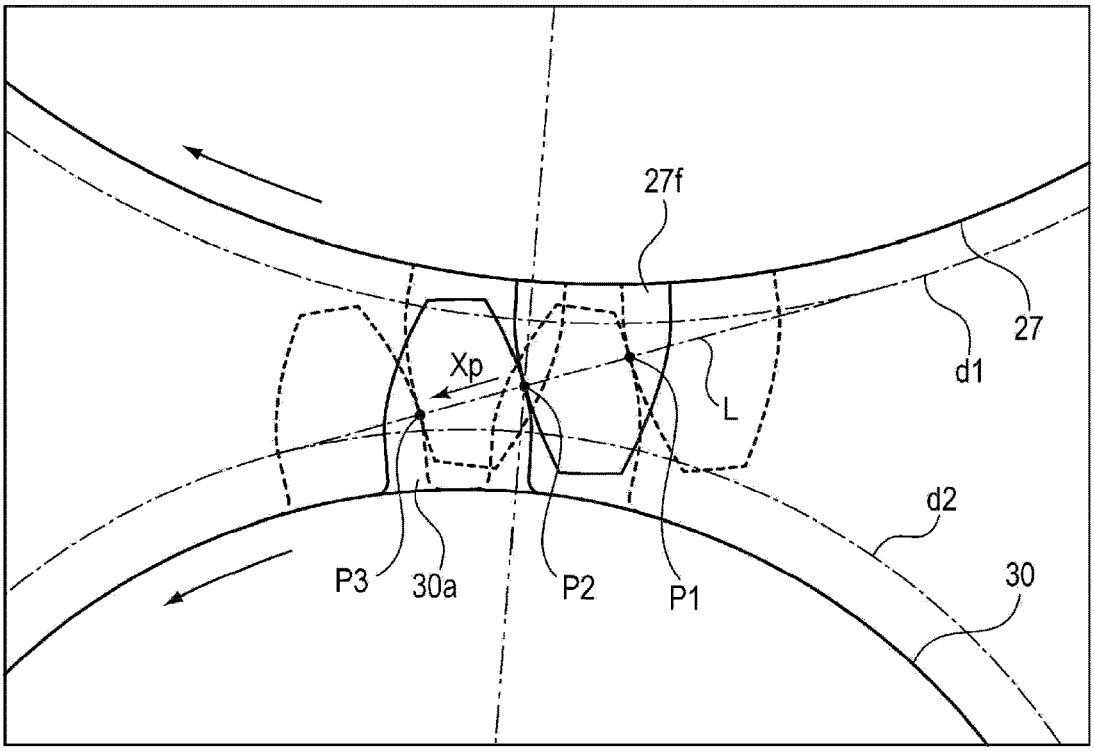
Figure 3:
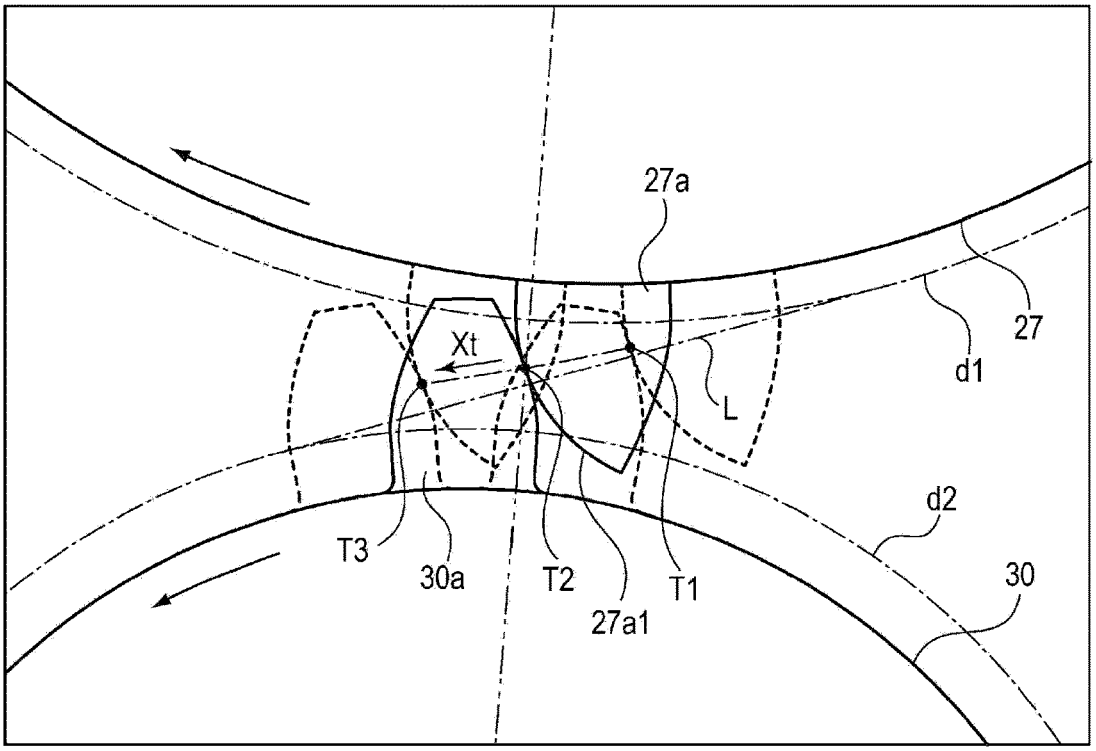

Part (a) of FIG. 3 is a drawing for describing the meshing between a pair of gears having ordinary teeth, and part (b) of FIG. 3 is a drawing for describing the meshing between a gear having ordinary teeth, and a gear having teeth different in shape from an ordinary tooth.

Figure 4:
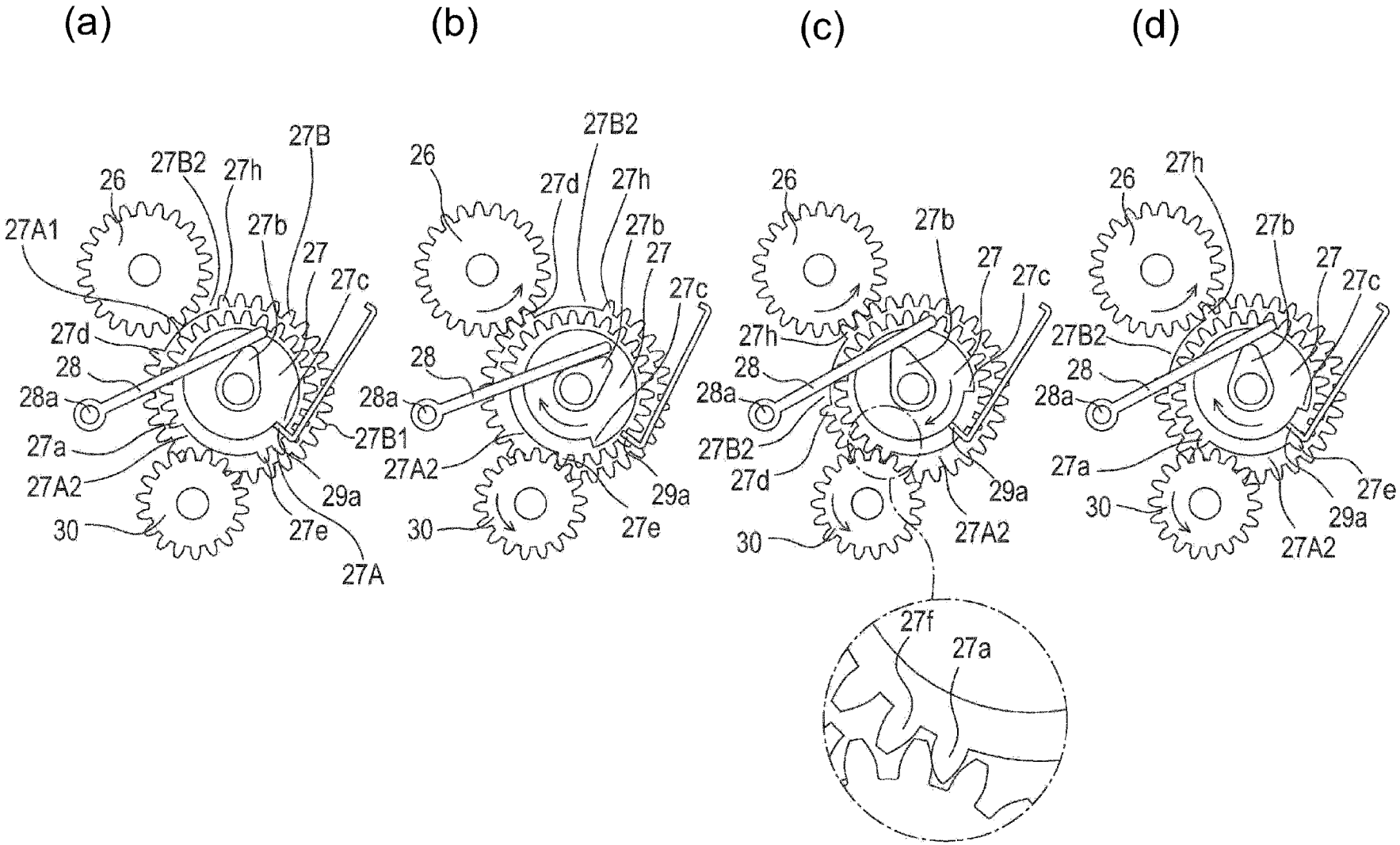

Parts (a)-(d) of FIG. 4 are drawings for describing the operation of the driving force transmitting portion of the sheet feeding apparatus in the first embodiment.

Figure 5:
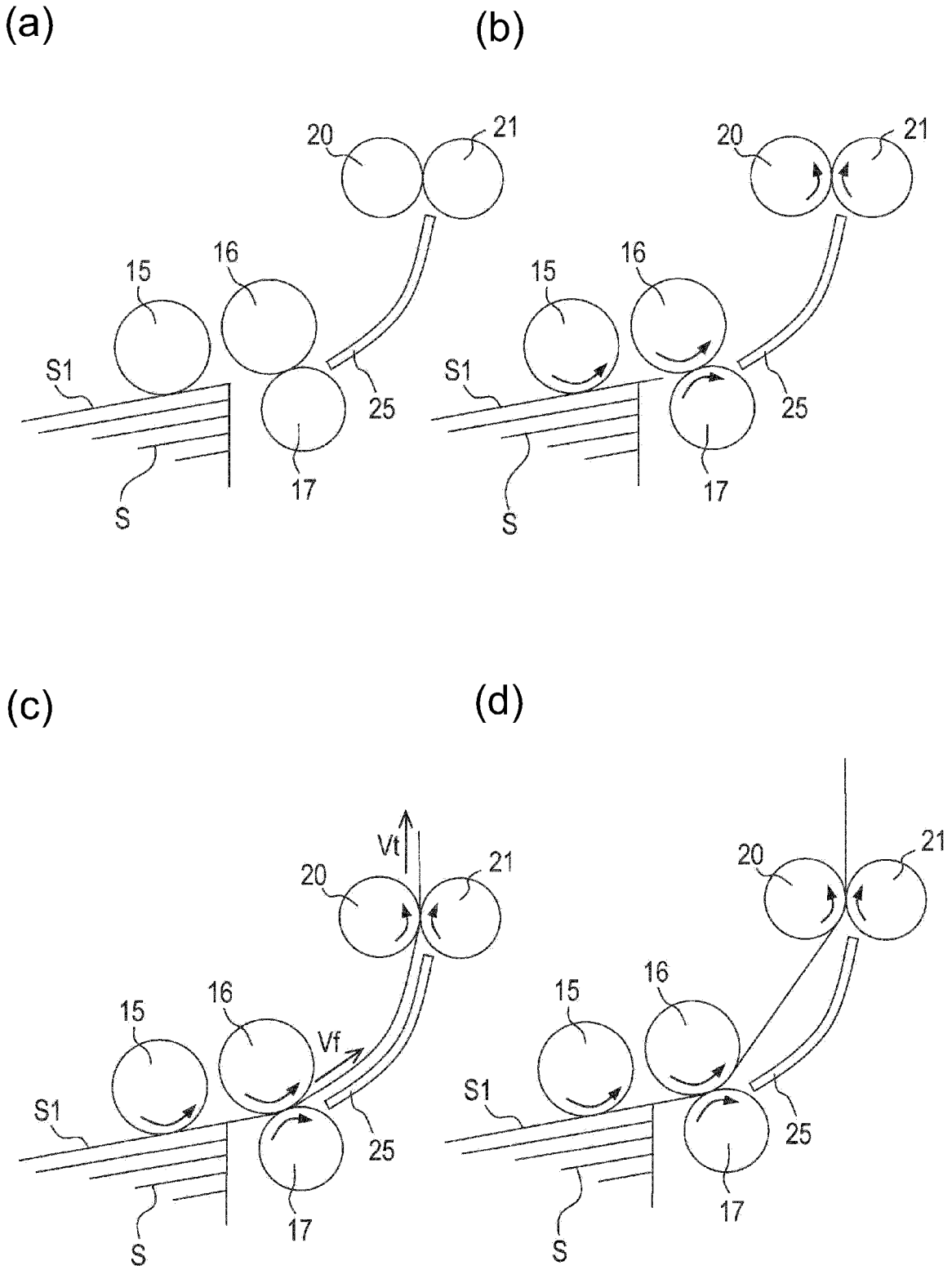

Parts (a)-(d) of FIG. 5 are drawings for describing the movement of a sheet of recording medium in the sheet feeding apparatus in the first embodiment.

Figure 6:
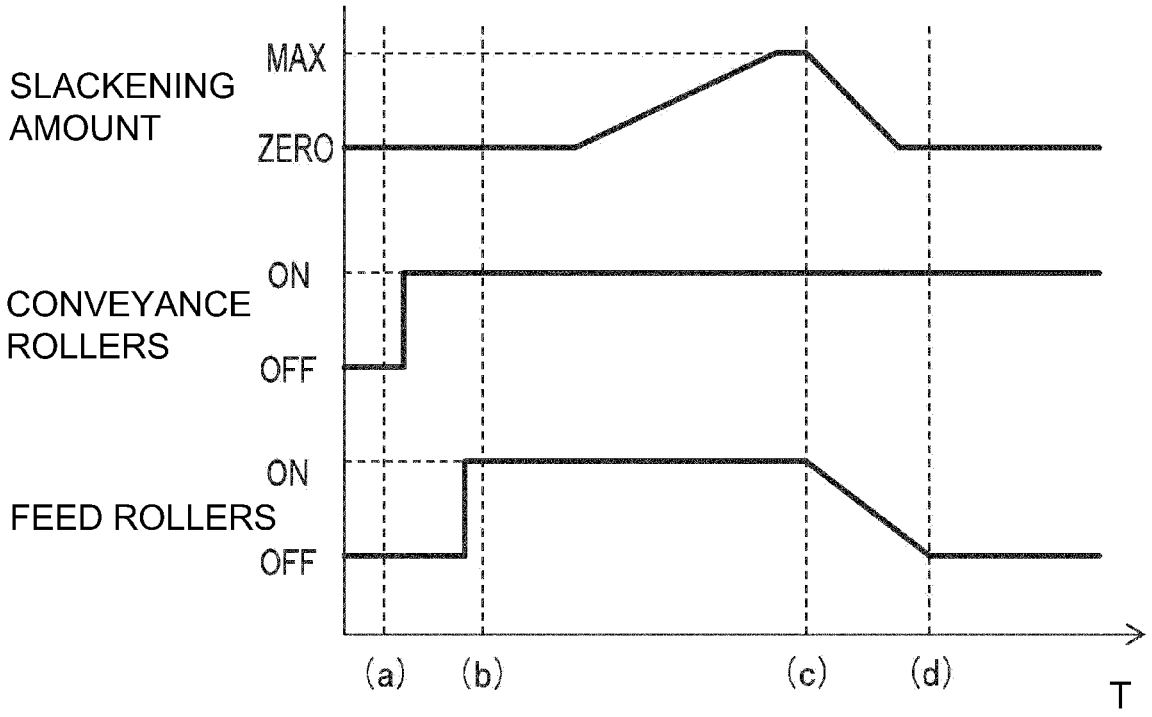

FIG. 6 is a drawing which shows the relationship between the timings with which the feed roller of the sheet feeding apparatus, and the pair of conveyance rollers, of the sheet feeding apparatus in this embodiment, are turned on or off, and the amount of slackening of a sheet of recording medium.

Figure 7:
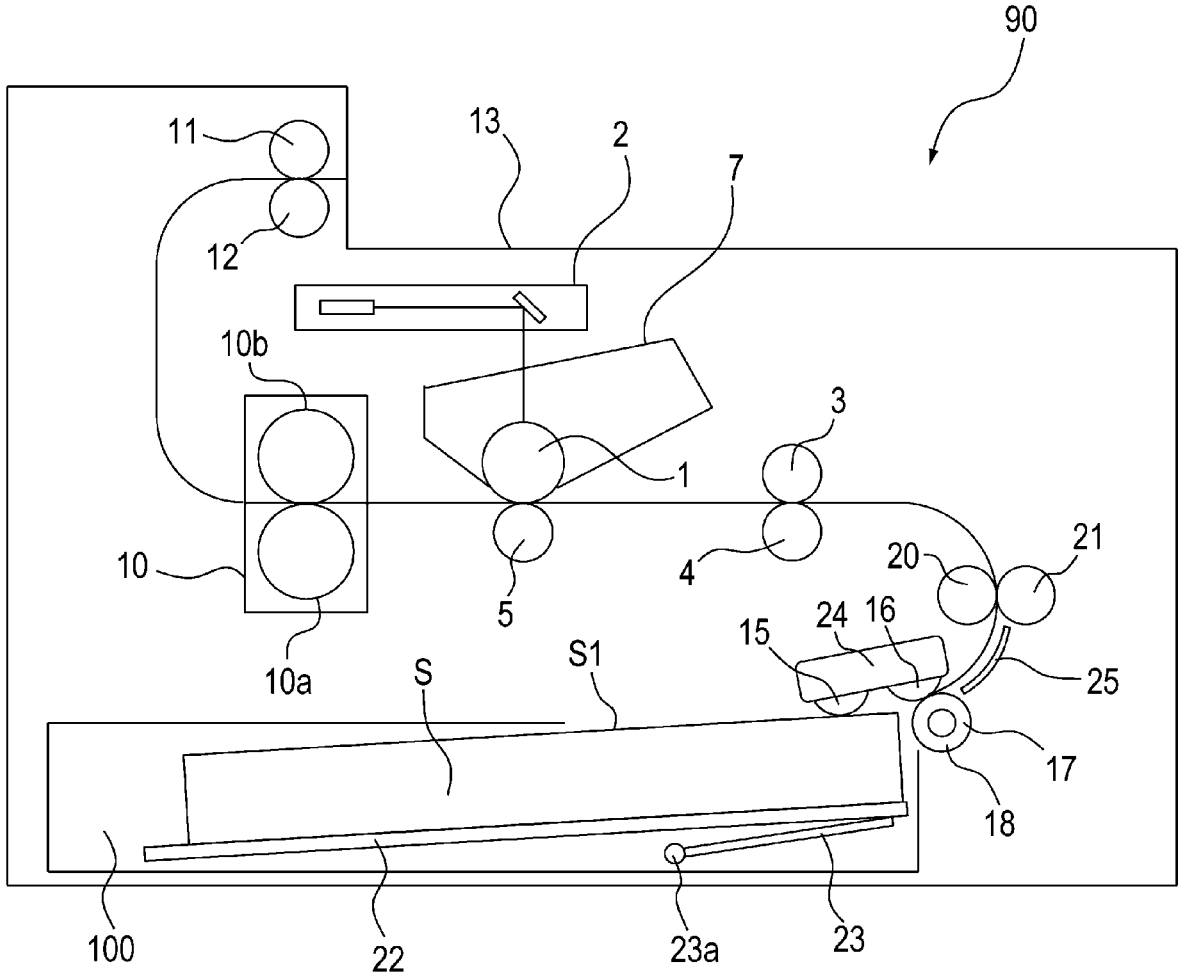

FIG. 7 is a schematic sectional view of a printer having the sheet feeding apparatus in the first embodiment.

Figure 8:
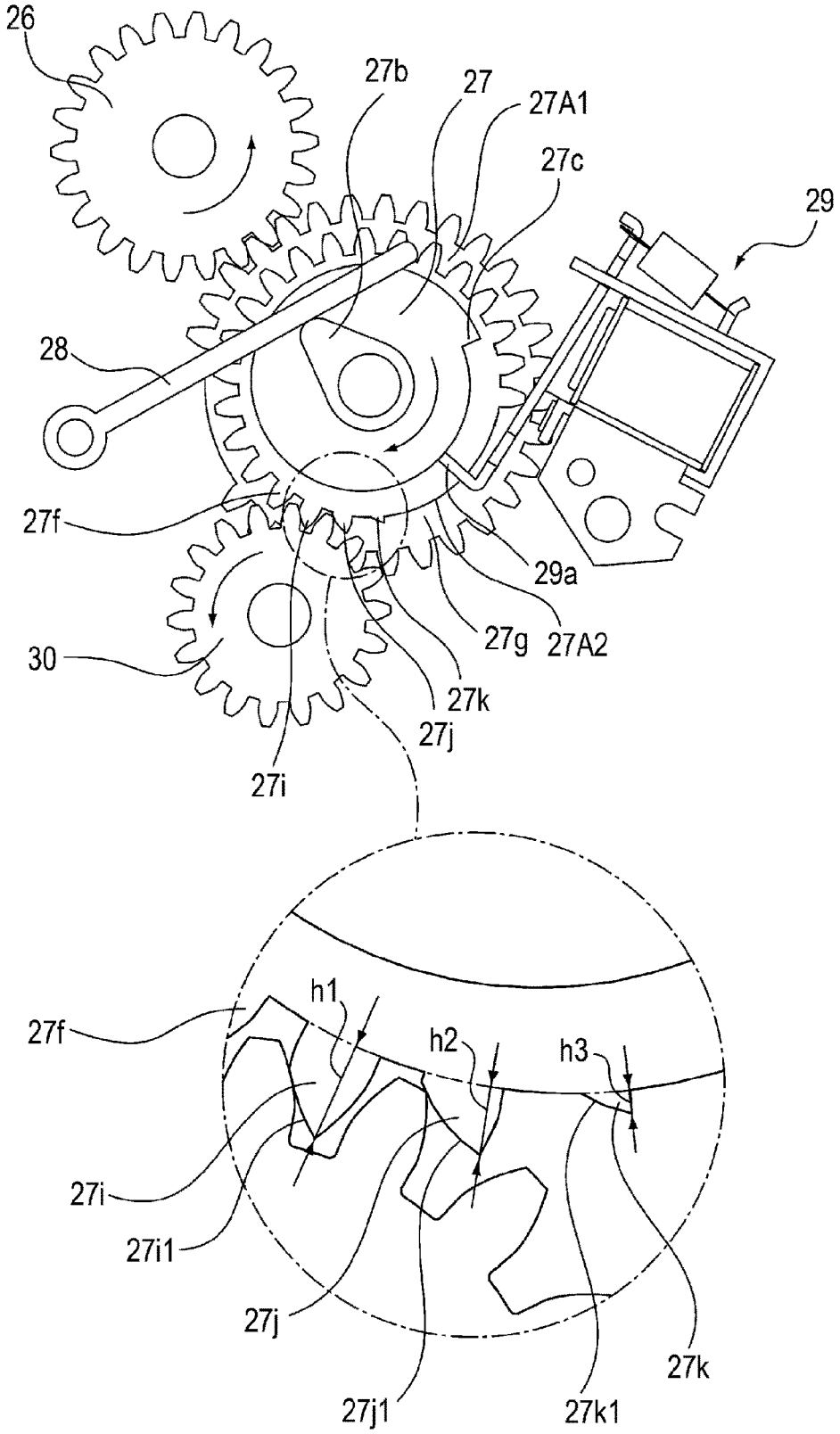

FIG. 8 is a side view of the driving force transmitting portion of the sheet feeding apparatus in the second embodiment of the present invention.

Figure 9:
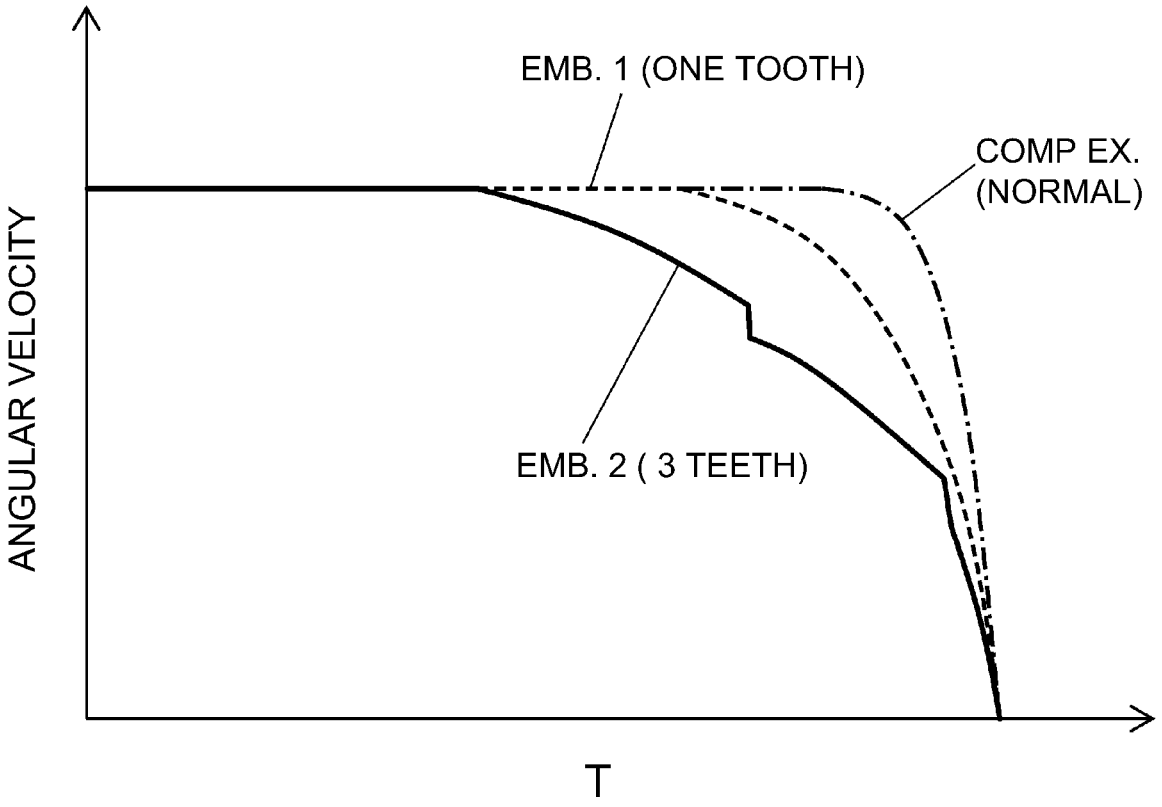

FIG. 9 is a graph which shows the angular velocity of the driven gear of the sheet feeding apparatus in the second embodiment.

Figure 10:
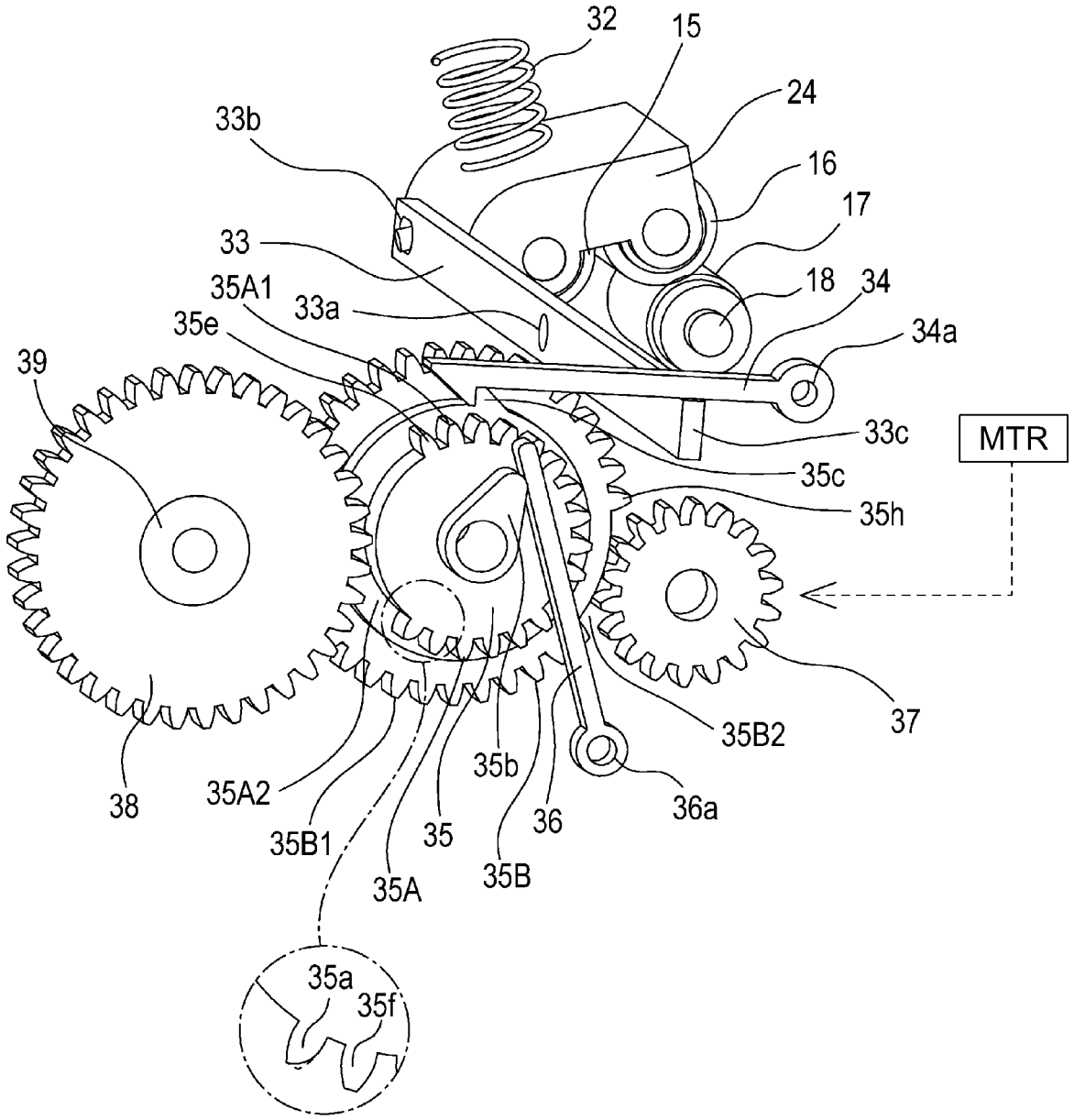

FIG. 10 is a perspective view of the driving force transmitting portion of the sheet feeding apparatus in the third embodiment of the present invention.

Figure 11:
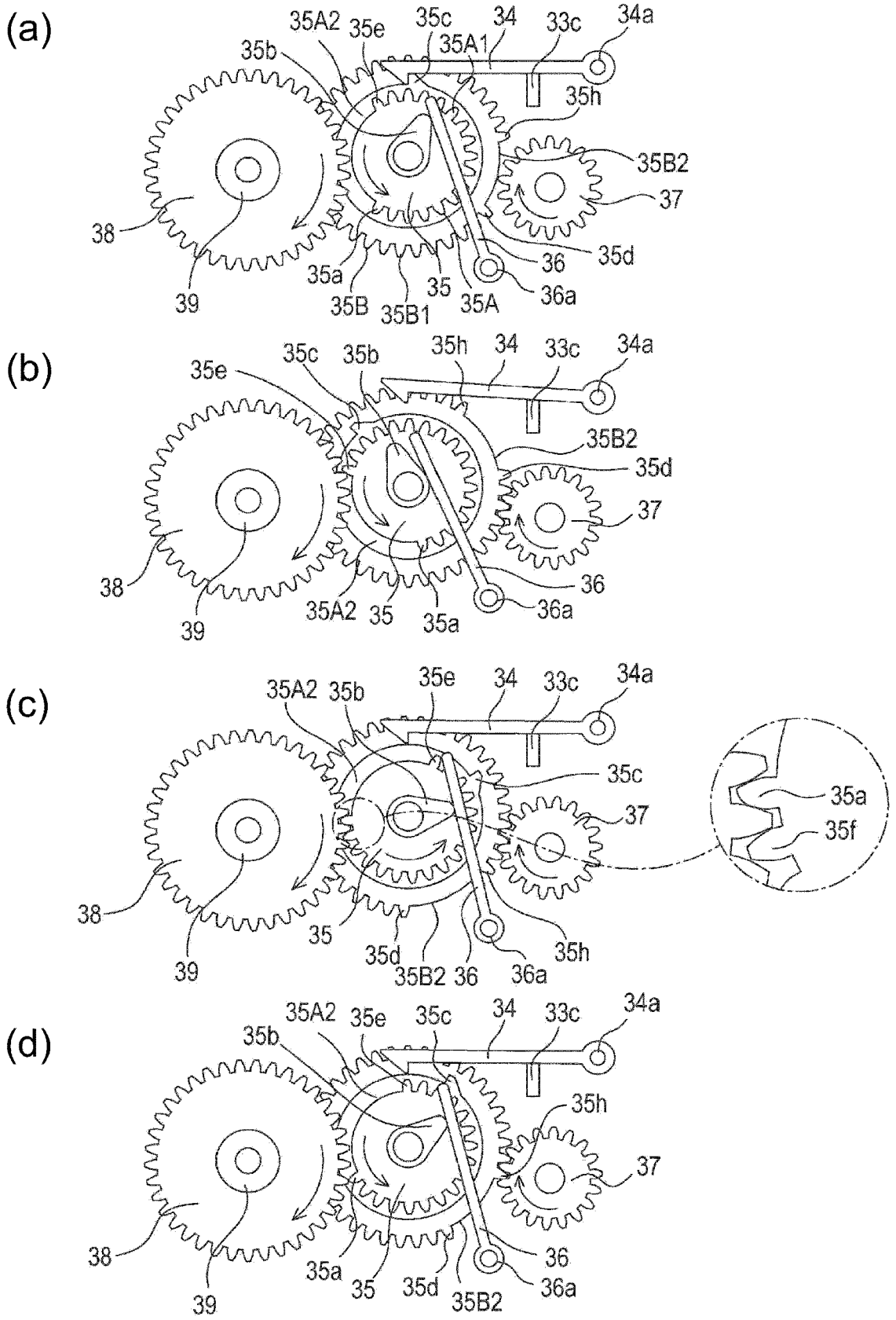

Parts (a)-(d) of FIG. 11 are drawings for describing the operation of the driving force transmitting portion of the sheet feeding apparatus in the third embodiment.

Figure 12:
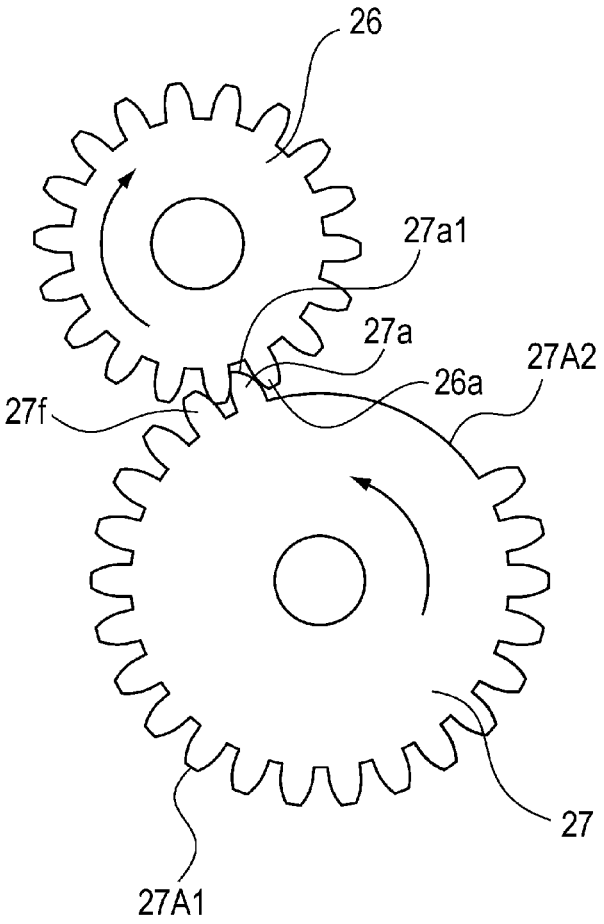

FIG. 12 is a drawing of the driving force transmitting portion of the sheet feeding apparatus in another embodiment of the present invention.

Figure 13:
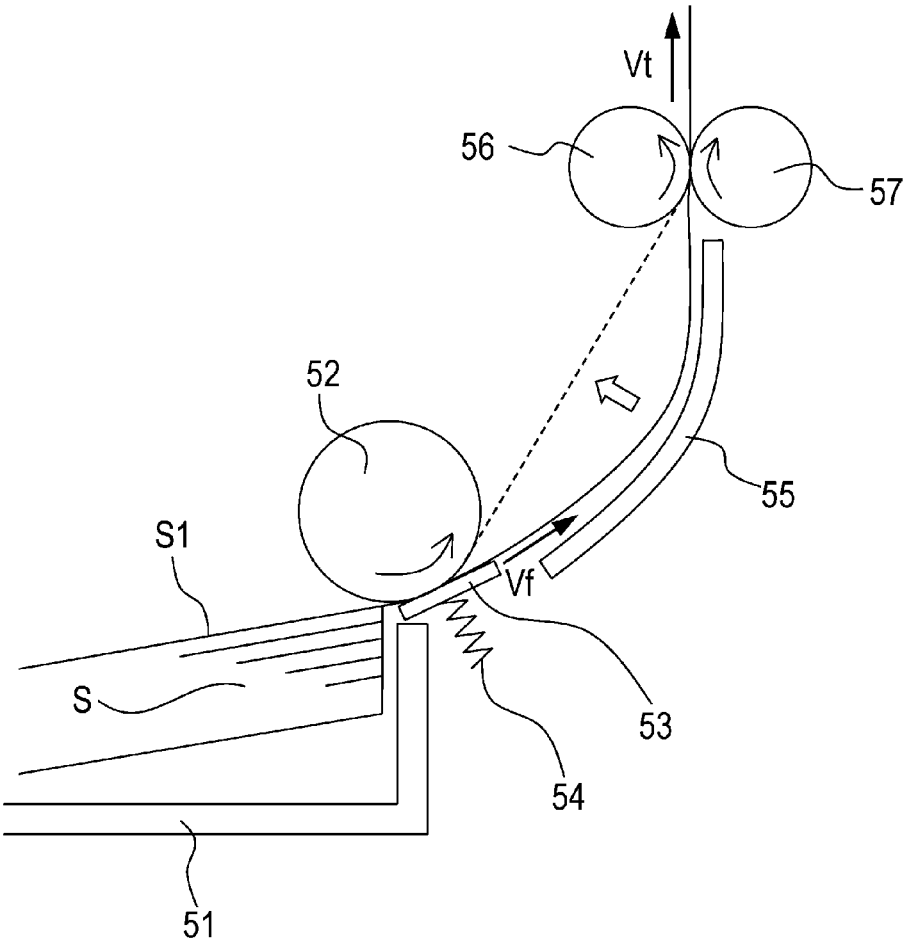

FIG. 13 is a drawing for describing an example of conventional sheet feeding apparatus.

Figure 14:
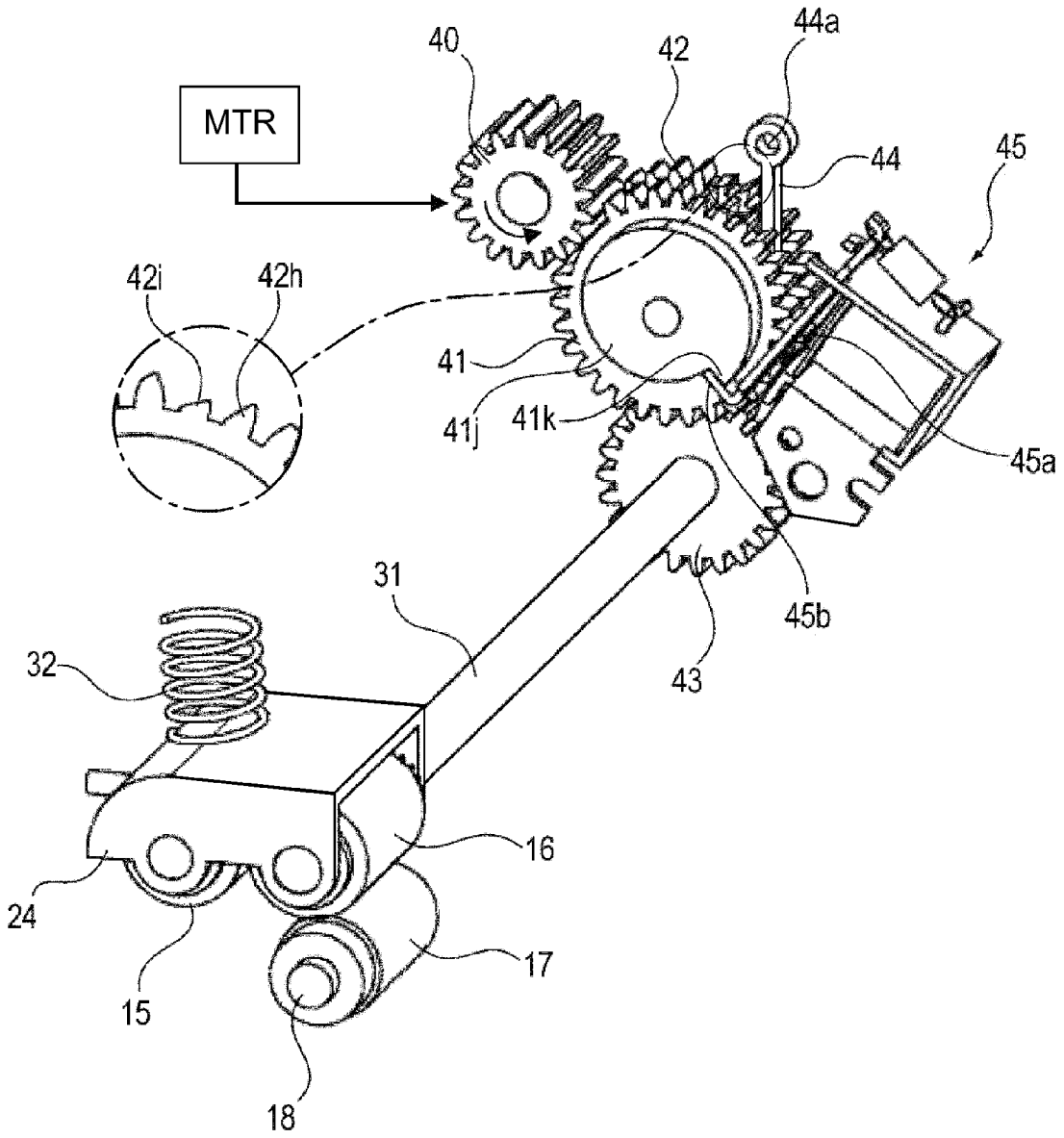

FIG. 14 is a perspective view of the driving force transmitting portion of the sheet feeding apparatus in the fourth embodiment of the present invention.

Figure 15:
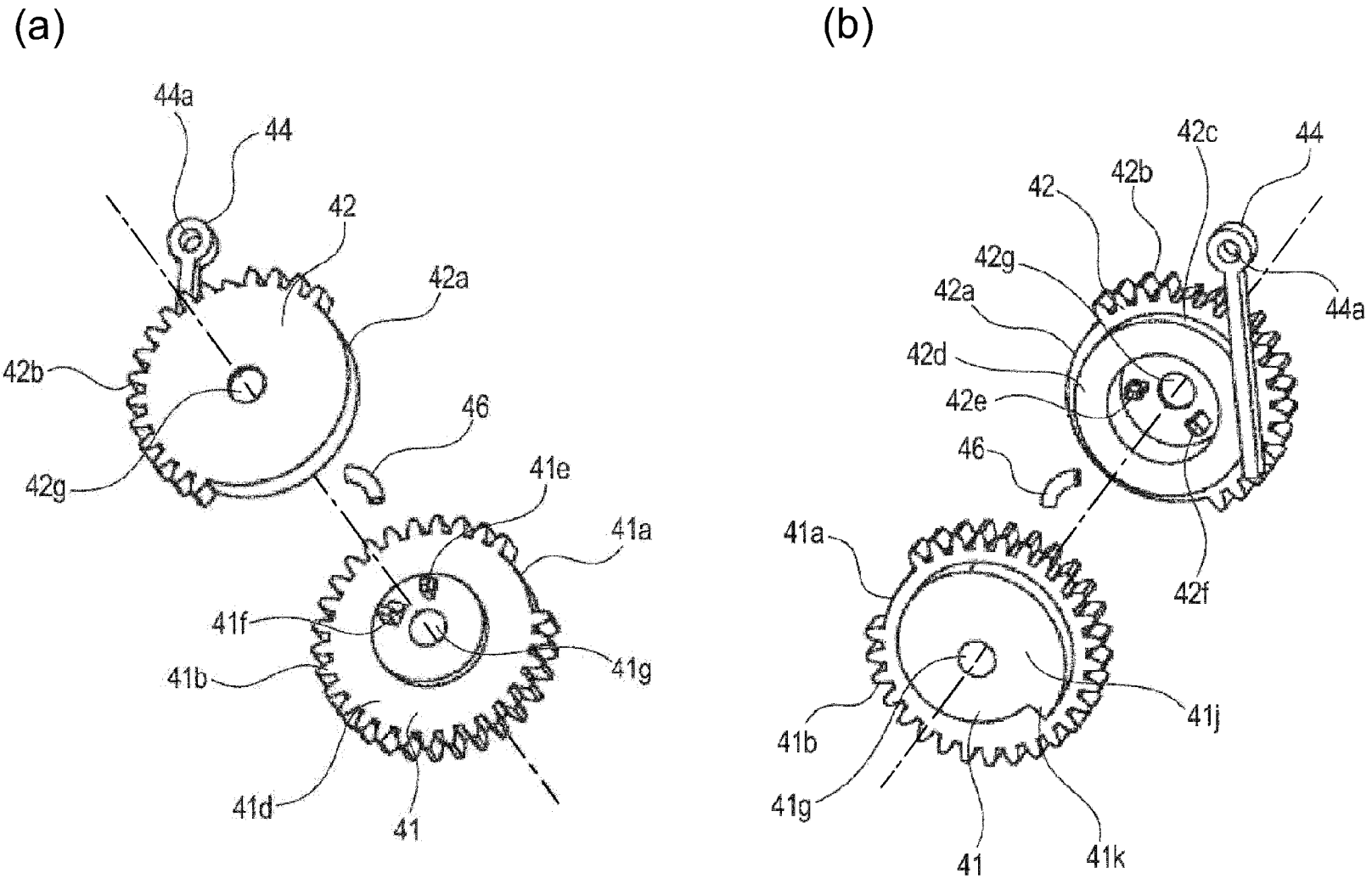

Parts (a) and (b) of FIG. 15 are perspective views of the partially toothed two-piece gear disassembled in the direction parallel to its axial line.

Figure 16:
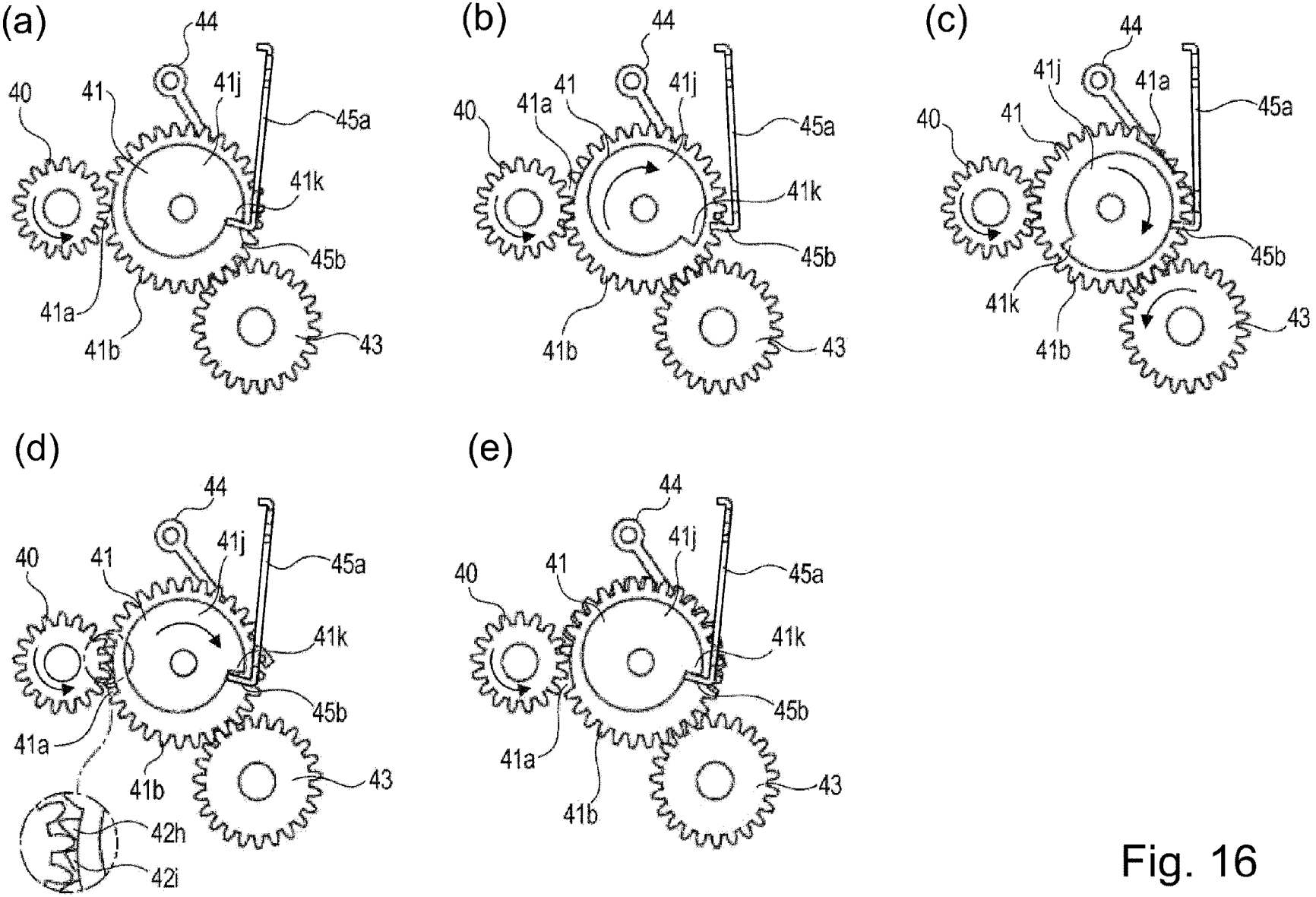

Parts (a)-(e) of FIG. 16 are drawings for describing the operation of the driving force transmitting portion in the fourth embodiment.

Figure 17:
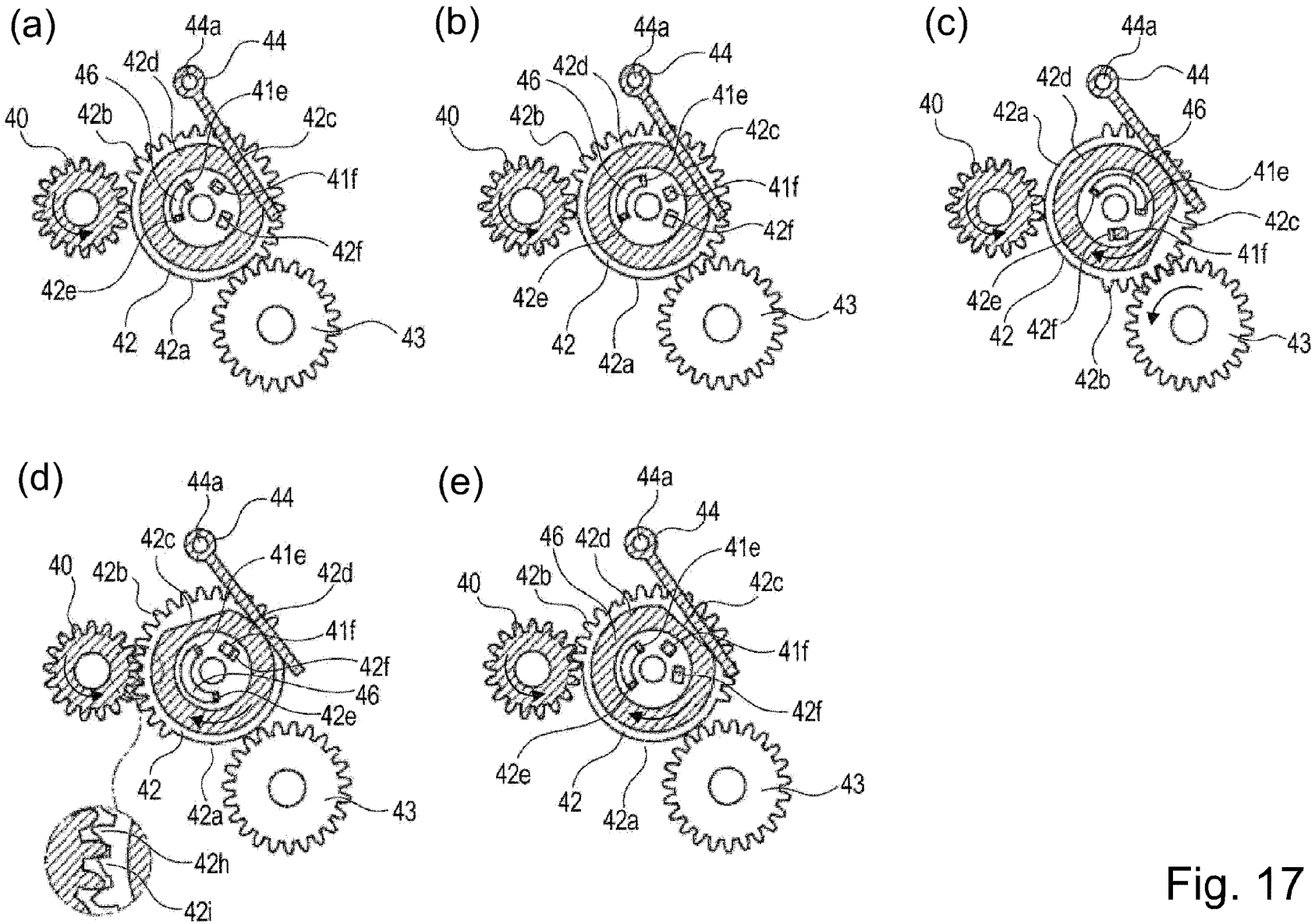

Parts (a)-(e) of FIG. 17 are drawings for describing the operation of the driving force transmitting portion in the fourth embodiment.

Figure 18:
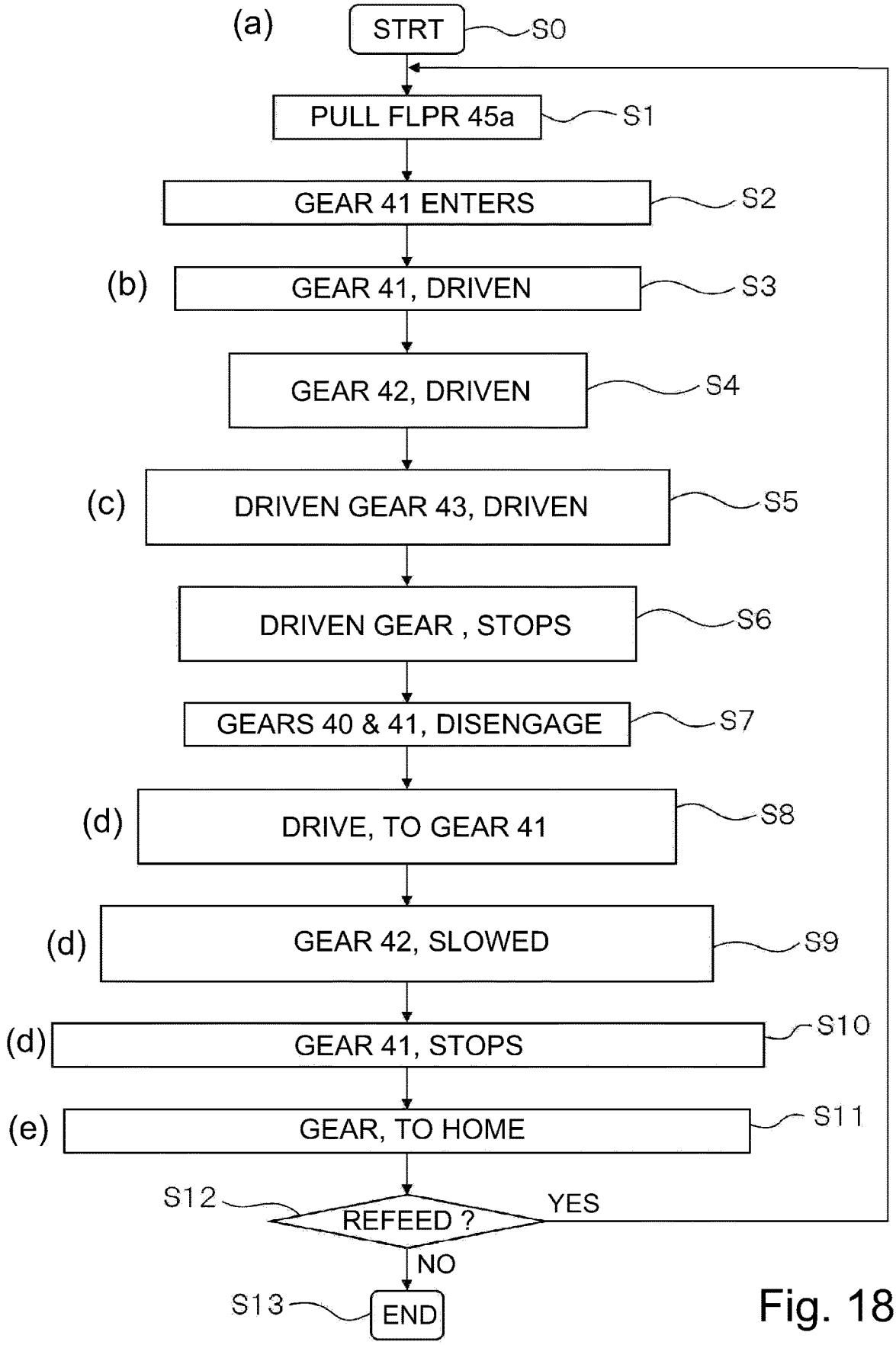

FIG. 18 is a block diagram of the operational sequence of the driving force transmitting portion in the fourth embodiment.

Figure 19:
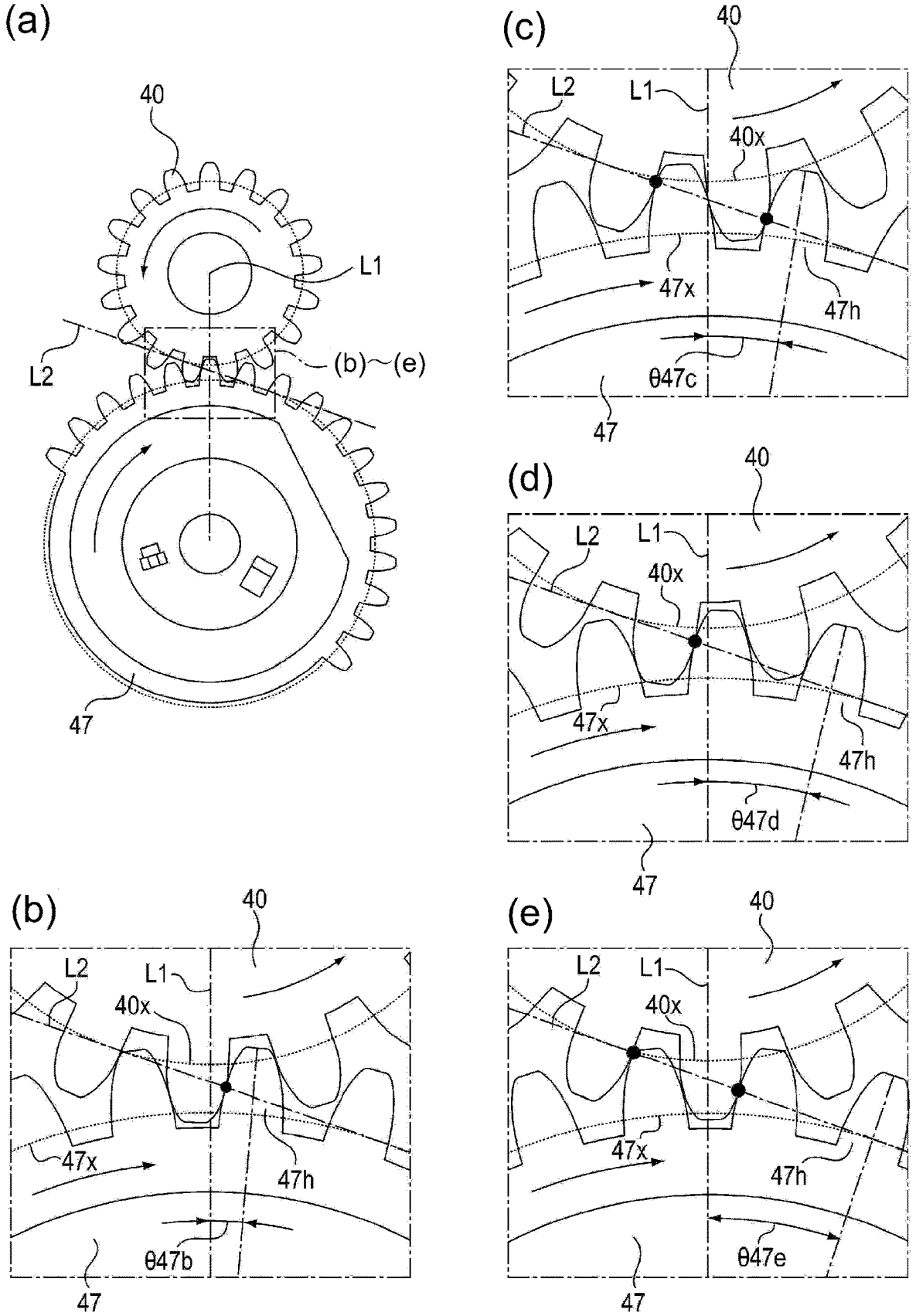

Part (a) of FIG. 19 is a drawing for showing the shape of the teeth of the connective gear of one of the comparative driving force transmitting portions, and parts (b)-(e) of FIG. 19 are drawings for showing the operation of the connective gear.

Figure 20:
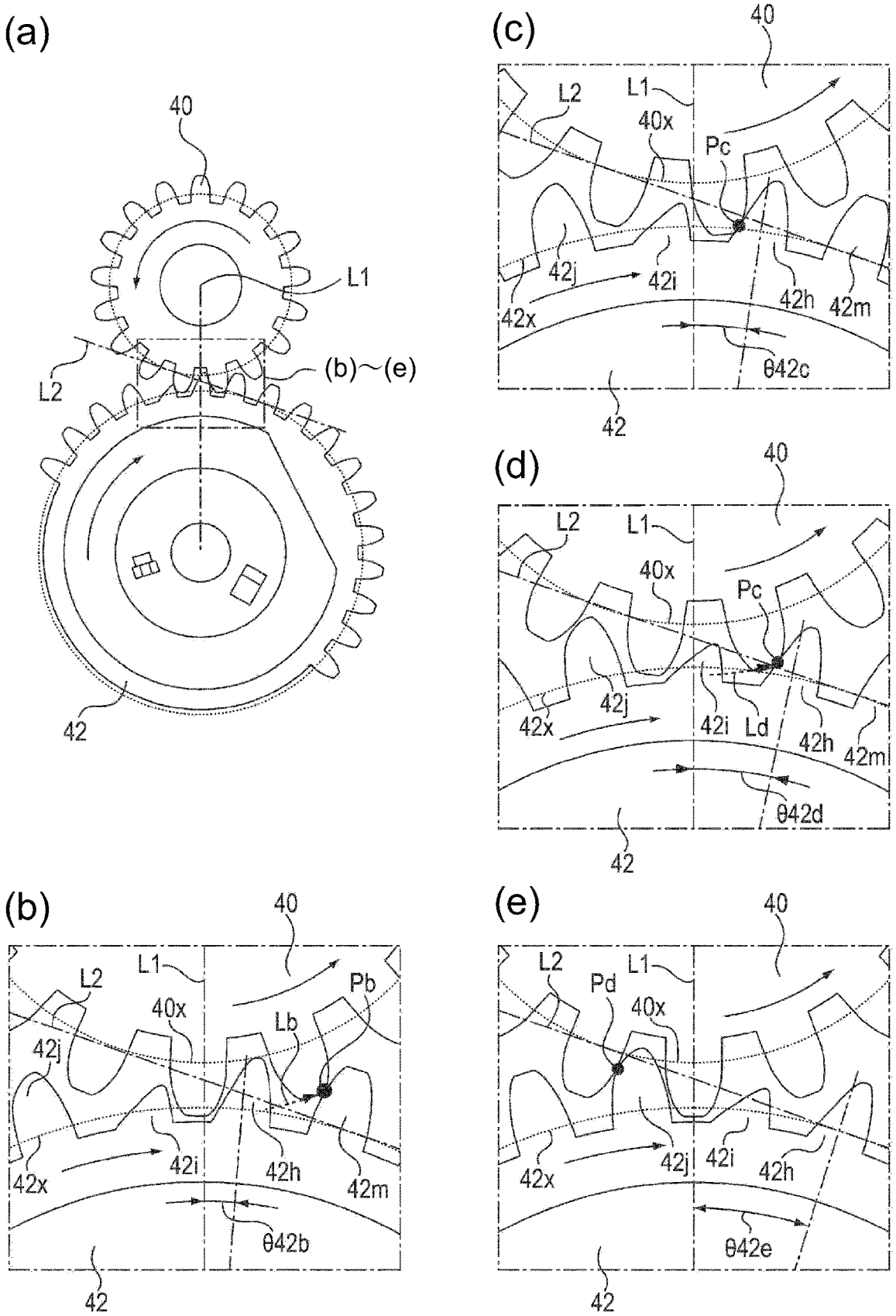

Part (a) of FIG. 20 is a drawing for showing the shape of the teeth of the connective gear of the driving force transmitting portion in the fourth embodiment, and parts (b)-(e) of FIG. 20 are drawings for showing the operation of the connective gear in the fourth embodiment.

Figure 21:
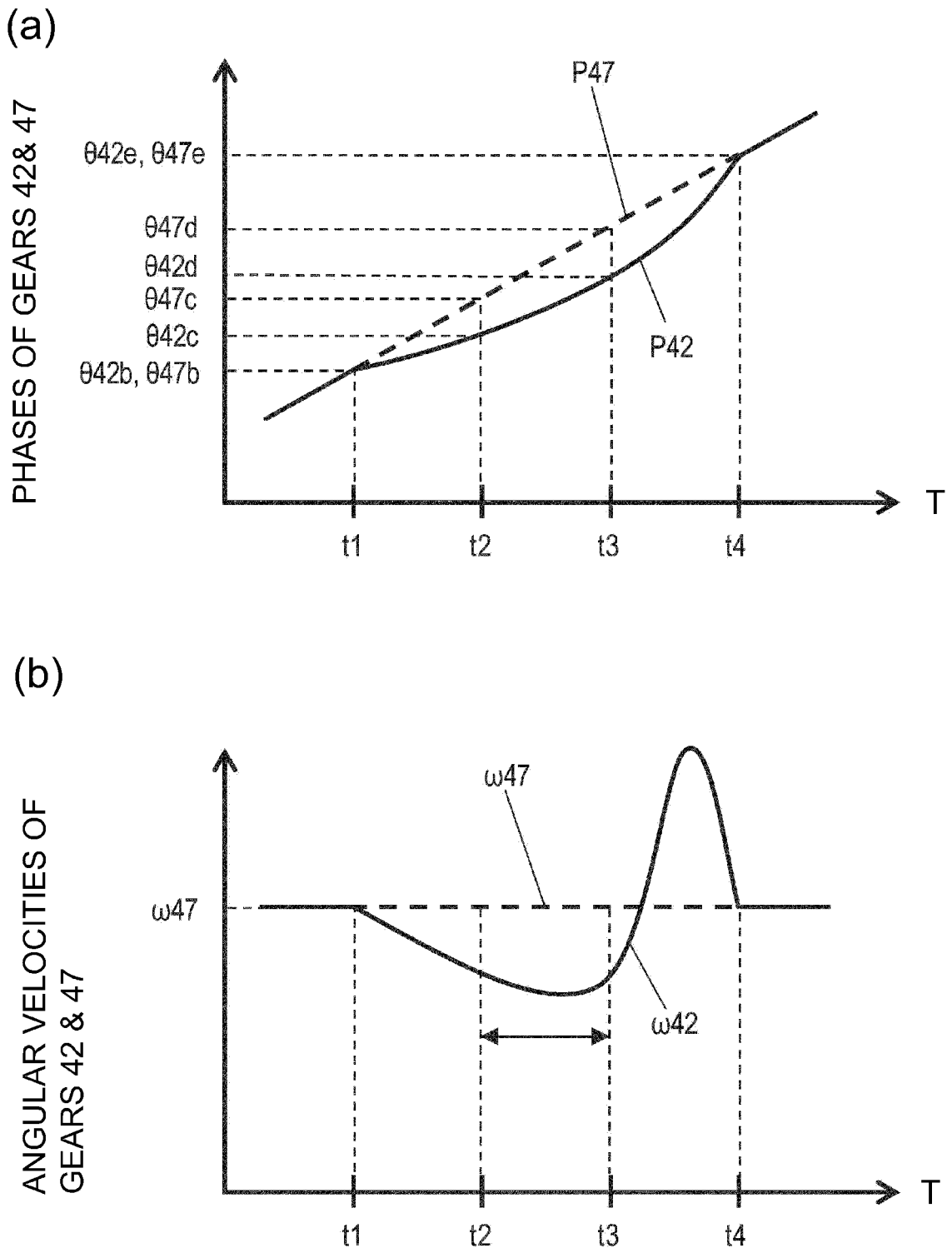

Parts (a) and (b) of FIG. 21 are graphs which show the relationship among the rotational phase of the connective gear 42, rotational phase of the connective gear 47, and elapsed time, and the relationship among the angular velocity of the connective gear 42, angular velocity of the connective gear 47, and elapsed time, respectively.

Figure 22:
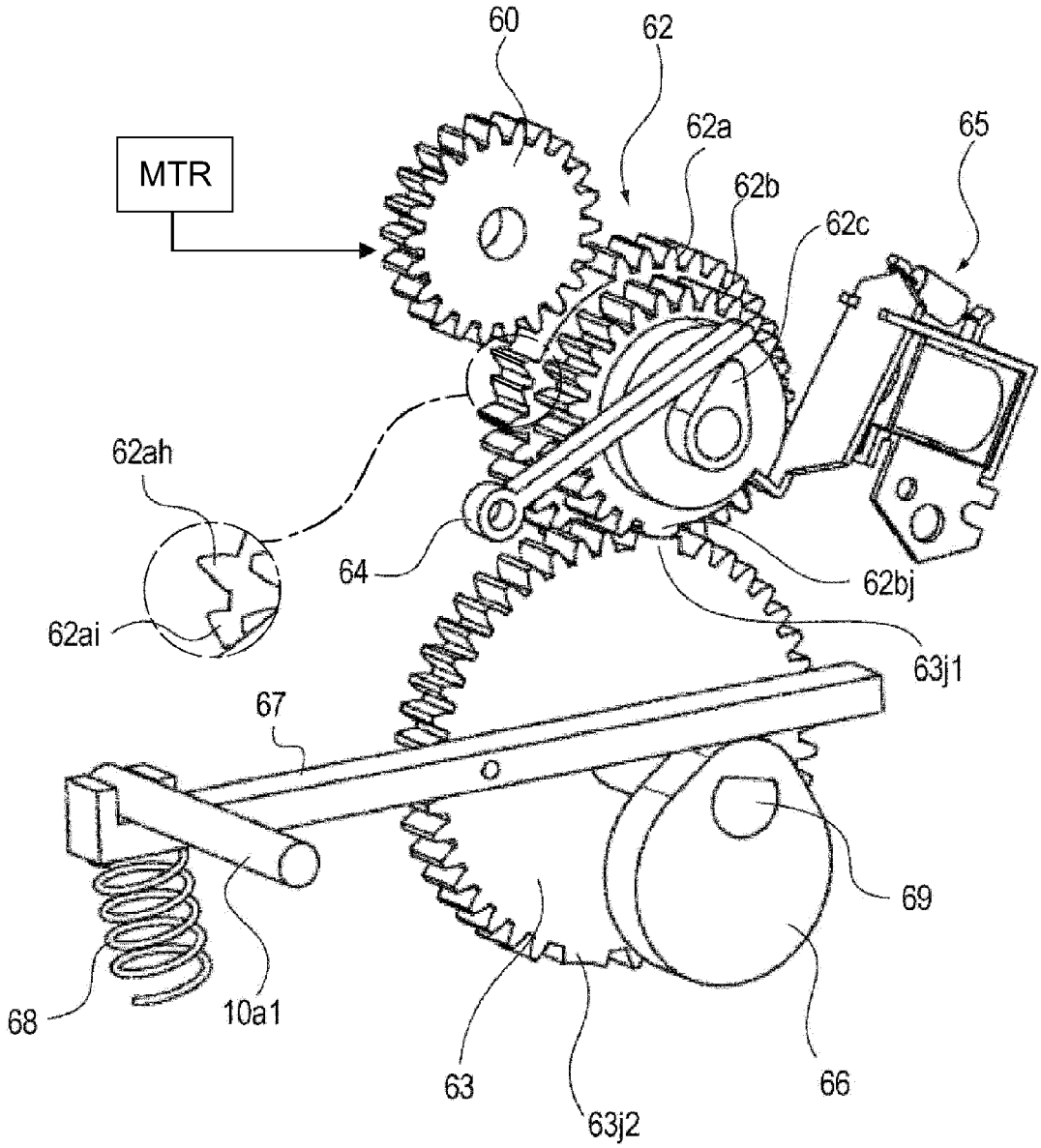

FIG. 22 is a perspective view of the driving force transmitting portion in the fifth embodiment of the present invention.

Figure 23:
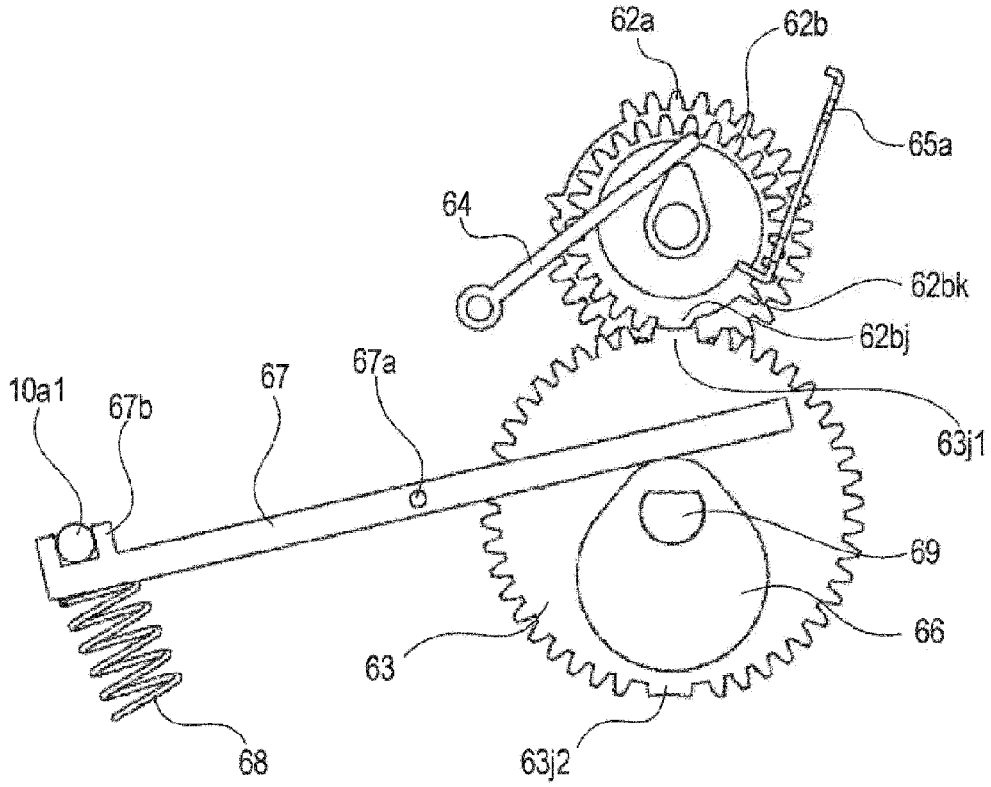
Figure 23:
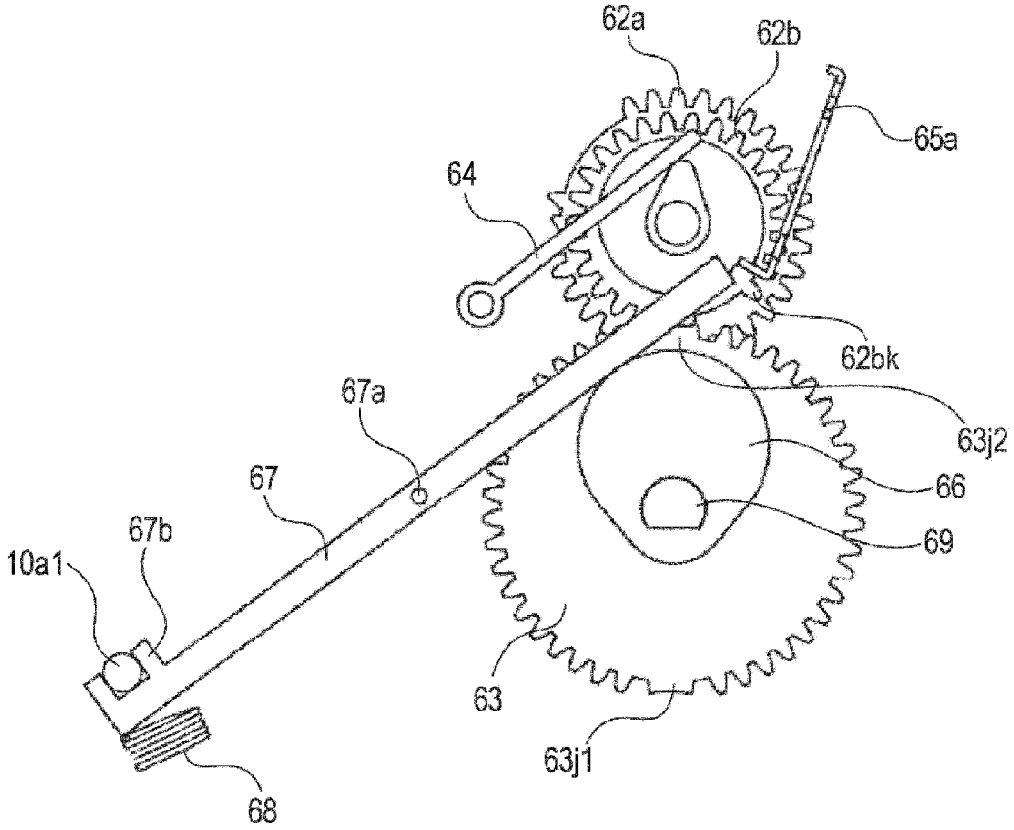

Parts (a) and (b) of FIG. 23 are drawings for describing the operation of the driving force transmitting portion and the movement of the shaft of the pressure roller, in the fifth embodiment.

Figure 24:
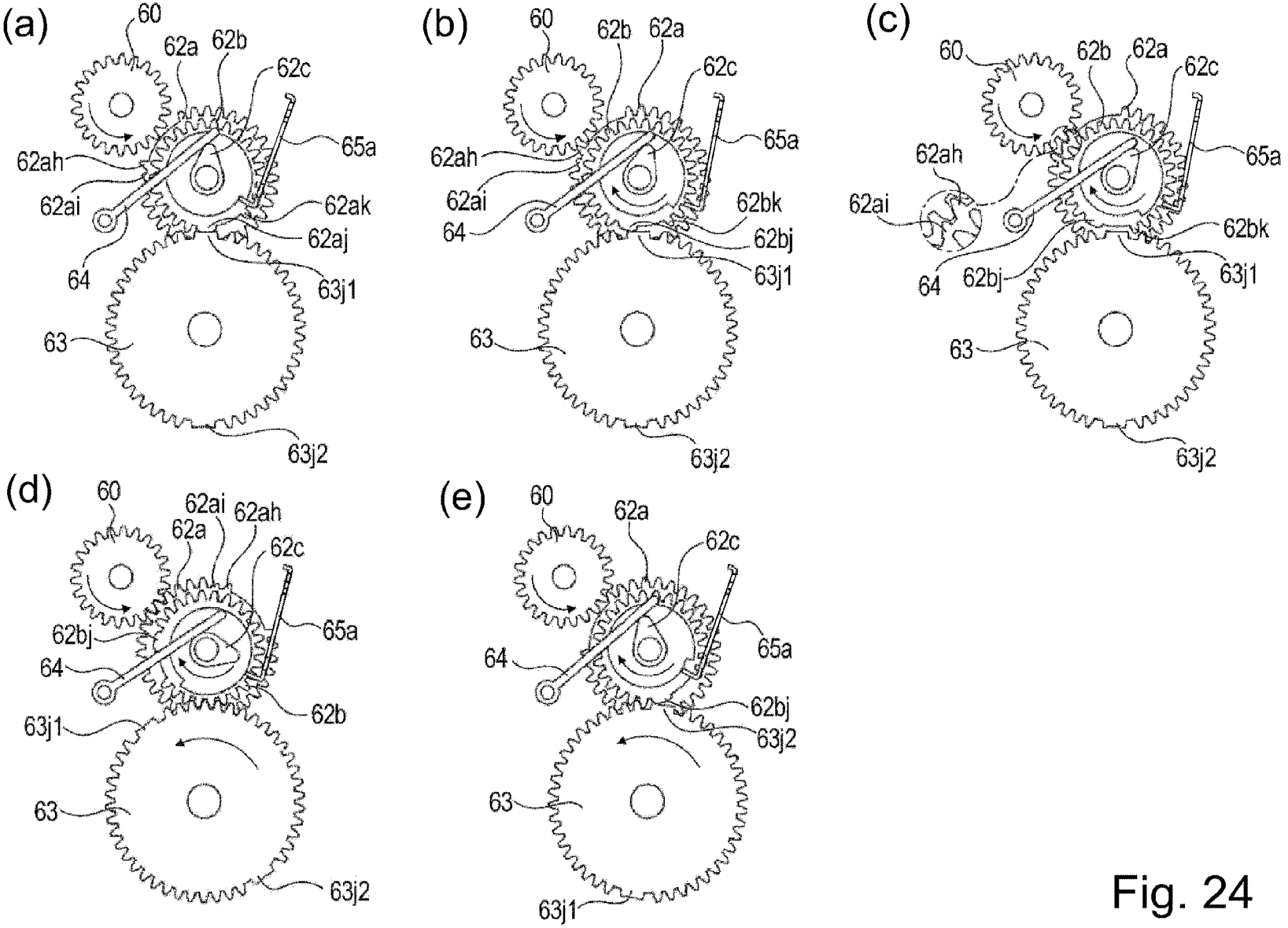

Parts (a)-(e) of FIG. 24 are drawings which show the operation of the driving force transmitting portion in the fifth embodiment.

DESCRIPTION OF THE EMBODIMENTS

The embodiments of the present invention, which will be described next, are a few of preferred embodiments of the present invention. That is, the concrete means, structural arrangements, etc., in the following embodiments of the present invention are not intended to limit the present invention in terms of the specific characteristics of the present invention.

Embodiment 1

Hereinafter, some of the preferred embodiments of the present invention are described in detail with reference to appended drawings. To begin with, referring to FIG. 7, an example of image forming apparatus equipped with the sheet feeding apparatus in the first embodiment of the present invention is described. FIG. 7 is a schematic sectional view of a monochromatic printer (which hereafter will be referred to simply as printer), which is an example of image forming apparatus equipped with the sheet feeding apparatus in the first embodiment.

<Overall Structure of Printer>

Referring to FIG. 7, the printer 90 uses a photosensitive drum 1, as an image bearing member, which is in a cartridge 7. The cartridge 7 has processing means such as a charging means and developing means, which process the photosensitive drum 1, in addition to the photosensitive drum 1. It is structured so that it is removably mountable in the printer 90. The printer 90 is also provided with an exposing means 2, which is disposed in the adjacencies of the peripheral surface of the photosensitive drum 1 to form an image on the peripheral surface of the photosensitive drum 1 by scanning the peripheral surface of the photosensitive drum 1 with a beam of laser light which it emits while modulating the beam according to the information of the image to be formed. Further, the printer 90 is provided with a transfer roller 5 for transferring a toner image on the photosensitive drum 1, onto a sheet S of recording medium. A combination of photosensitive drum 1, exposing means, and transfer roller 6 makes up an image forming means.

The printer 90 is provided with a sheet feeding apparatus which is made up of a sheet holding plate 22 as a means on which sheets are placed, a pickup roller 15, a pair of feed rollers 16 and 17 as a feeding means, a pair of conveyance rollers 20 and 21 as a conveying means, etc.

When the printer 90 is on standby, sheets S of recording medium, such as recording paper, set in a sheet feeder cassette 100, are held up by the sheet holding plate so that the top sheet S1 is held in the position from which it can be fed into the main assembly of the printer 90, and the top sheet S1 is in contact with the pickup roller 15. Each of the pickup roller 15 and feed roller 16 contains a one-way clutch (unshown). The separation roller 17 is attached to the chassis or the like of the printer 90, with the placement of a torque limiter between itself and chassis. That is, the separation roller 17 is attached to the chassis or the like in such a manner that it retards sheet conveyance.

As a print signal is inputted, the top sheet S1, and one or more sheets S which are under the top sheet S1, are fed into the main assembly of the printer 90. Then, the top sheet S1 is separated from the rest by a combination of the feed roller 16 and separation roller 17 (which hereafter will be referred to as pair of feed rollers 16 and 17), and is conveyed further into the main assembly. After the separation of the top sheet S1 from the rest, it is conveyed further by the pair of conveyance rollers 20 and 21 as conveying means, and a pair of registration rollers 3 and 4 also as conveying means, to the nip between the photosensitive drum 1 and transfer roller 5, in which a toner image is transferred onto the surface of the sheet S1. Thereafter, the sheet S1 is conveyed to a fixing portion 10, in which the toner image on the sheet S1 is fixed to the sheet S1 by the heat and pressure supplied by the fixing portion. After the fixation of the toner image to the sheet S1, the sheet S1 is discharged into a delivery portion 13 by a pair of discharge rollers 11 and 12.

<Structure of Sheet Feeding Apparatus>

Figure 1:
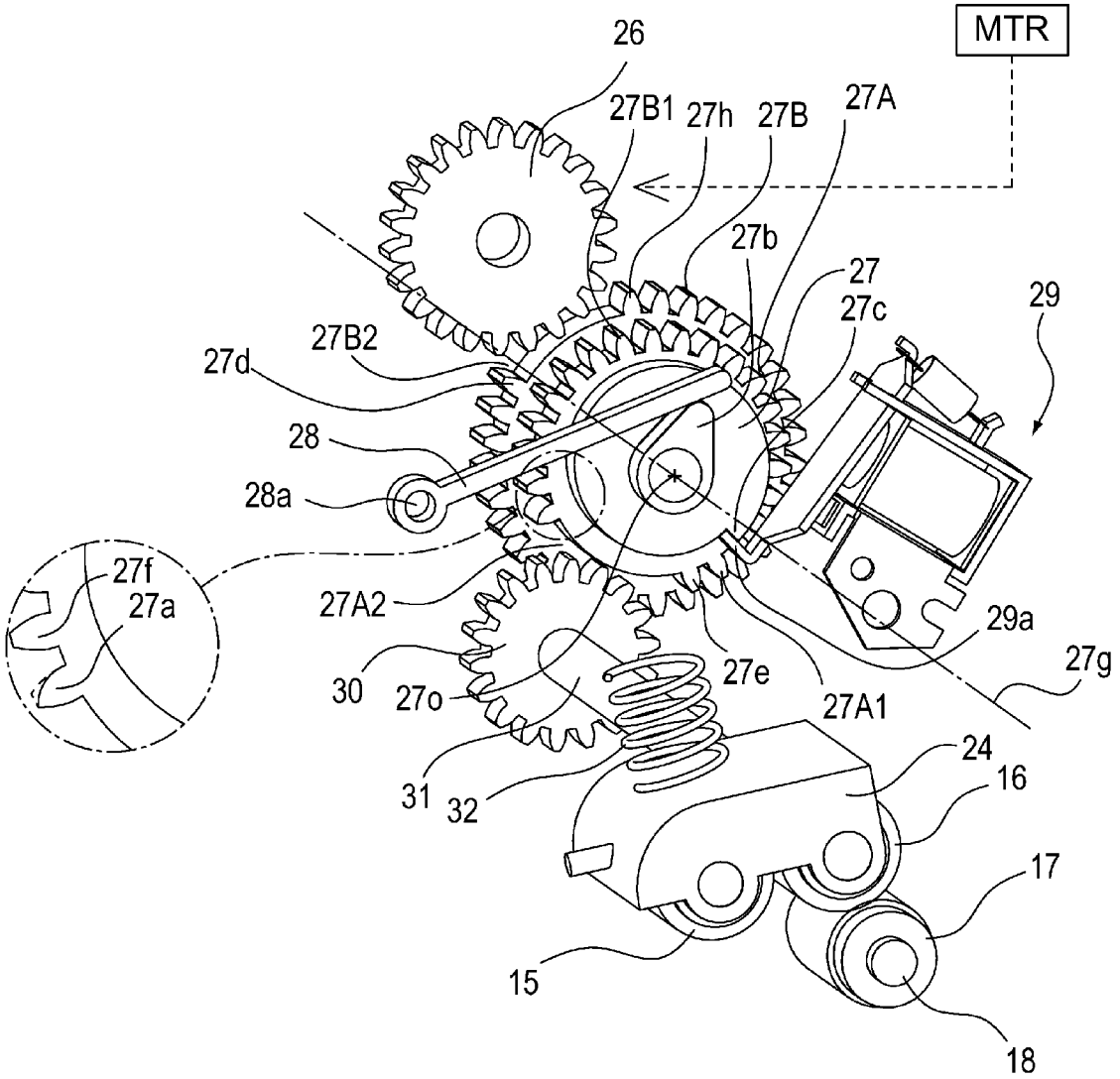
FIG. 1 is a perspective view of the driving force transmitting portion of the sheet feeding apparatus in the first embodiment of the present invention.

Next, referring to FIG. 1, the structure of the driving force transmitting portion of the sheet feeding apparatus in the image forming apparatus described above is described in detail. FIG. 1 is a perspective view of the driving force transmitting portion (driving force transmitting device) of the sheet feeding apparatus.

Referring to FIG. 1, the driving force transmitting portion, as a driving force transmitting device, is provided with a driving gear 26, a partially toothed gear 27 as the first gear, a driven gear 30 as the second gear, a solenoid 29 as an engaging member, a pressure lever 28 as a rotational force applying means, etc.

In FIG. 1, the driving gear 26 is such a gear that is in connection to a motor as a driving force source. The driven gear 30 is the second gear which is in connection to the feed roller 16. It is meshed with the partially toothed gear 27 as the first gear. It is such a driven gear that rotates by receiving driving force from the partially toothed gear 27. A drive shaft 31 is in connection to the driven gear 30 and feed roller 16, and transmits the rotation of the driven gear 30 to the feed roller 16.

The partially toothed gear 27, as the first gear, has a portion which has no tooth and does not mesh with the driving gear 26, and a portion which has multiple teeth which mesh with the teeth of the driving gear 26. It rotates by meshing with the driving gear 26. The partially toothed gear 27, or the first gear, is a driving force transmitting gear which gives driving force to the driven gear 30 by meshing with the driven gear 30, or the second gear. The partially toothed gear 27 has a portion which has no tooth by which it can contact other gears. The partially toothed gear 27 is a step gear having the first gear 27A (small gear) and a second gear 27B (large gear). The first gear 27A has a toothed portion 27A1 which has multiple teeth by which it meshes with the driven gear 30, and a toothless portion 27A as a portion having no tooth with which it can mesh with the driven gear 30. The second gear 27B has a toothed portion 27B1 as a portion having multiple teeth, with which it meshes with the driving gear 26, and a toothless portion 27B2 as a portion having no tooth with which it meshes with the driving gear 26.

Referring to FIG. 1, the partially toothed gear 27 has an engaging portion 27*c*, with which the flapper 29*a* of the solenoid 29 engages. At least one tooth 27*a*, or the first tooth, of the multiple teeth of the partially toothed gear 27, is different in shape from the other teeth of the partially toothed gear 27. More specifically, the aforementioned tooth 27*a*, or the first tooth, of the partially toothed gear 27 is shaped so that the partially toothed gear 27 begins to decelerate the driven gear 30 earlier than a gear structured so that all the teeth of the toothed portion 27*a*1 are the same in shape. The tooth 27*a*, or the first tooth of the partially toothed gear 27, in FIG. 1, is shaped so that its surface which comes into contact with one of the teeth of the driven gear 30 is given such a curvature (R-shaped), contoured by a dotted line, as shown in an enlarged side view of a combination of the tooth 27*a* and one of the normally shaped teeth 27*f*, that makes the surface smaller than the surface of the normally shaped tooth (involute tooth).

By the way, it is not mandatory that the shape of the tooth 27*a* of the partially toothed gear 27 has a smooth R-shape. It may be straight, or splined; it is optional. Further, it is not mandatory that the shape of the normal tooth of the partially toothed gear 27 is such that its contour is involute in cross-section. That is, it may be cycloidal, etc., in cross-sectional view. That is, the tooth 27*a*, or the first tooth of the partially toothed gear 27 shown in FIG. 1, is designed so that it is different in shape from other gears of the partially toothed gear 27, in consideration of the properties of its material, to transmit driving force, in terms of the point of meshing (contact), with which it contacts with the teeth of the driven gear 30.

Figure 2:
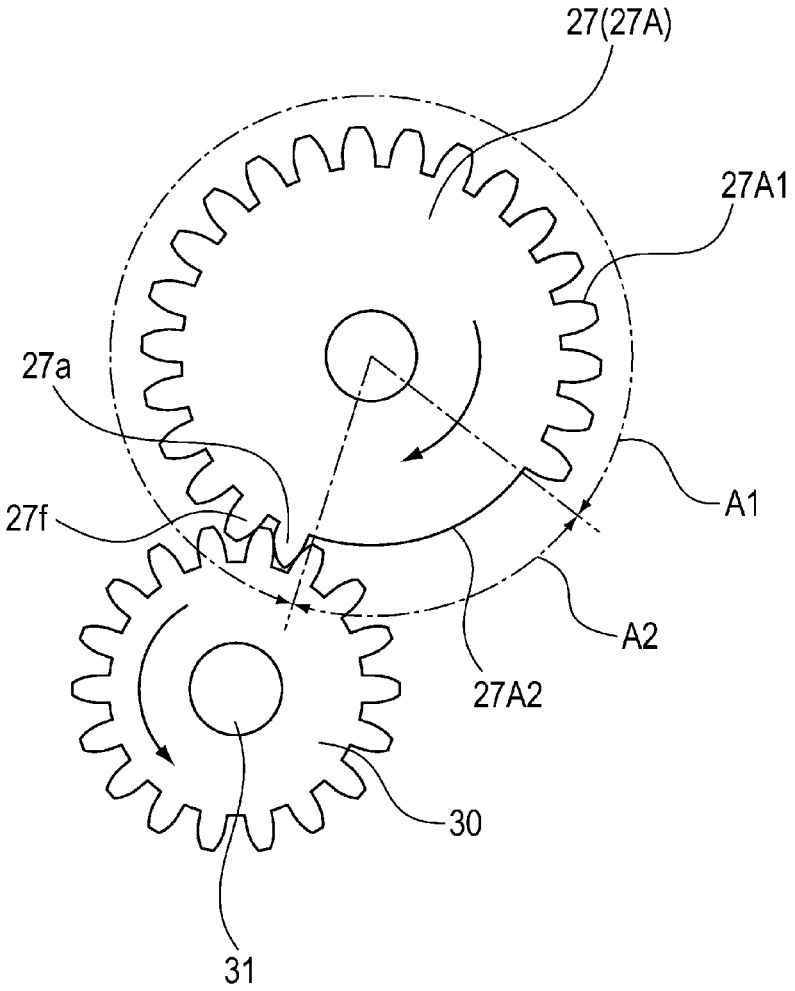
FIG. 2 is a drawing for describing the partially toothed gear in the first embodiment.

Next, referring to FIGS. 2 and 3, the toothed and toothless portions of the partially toothed gear 27, and the first gear 27A having the tooth 27*a*, or the first tooth of the partially toothed gear 27, are described in detail. FIG. 2 is a side view of a combination of the first gear of the partially toothed gear 27, which has the toothed and toothless portions, and the driven gear 30. By the way, FIG. 2 shows only the first gear 27A of the partially toothed gear 27 described above. FIG. 3 is a drawing for describing the meshing contact of gears. More specifically, part (a) of FIG. 3 is a drawing for describing the meshing of two gears which are the same in the shape of their teeth. Part (b) of FIG. 3 is a drawing for describing the contact between one of the teeth of the driven gear 30 and the first gear 27*a* of the partially toothed gear 27.

Referring to FIG. 3, the first gear 27A of the partially toothed gear 27 has multiple teeth, and rotates. Further, the first gear 27A has a portion which has no tooth, in terms of the rotational direction of the partially toothed gear 27. That is, the first gear 27A has a portion A1 having multiple teeth which mesh with the driven gear 30, and a portion A2 which has no tooth with which it meshes with the driven gear 30. Here, the portion A1 of the first gear 27A, which has multiple teeth, is referred to as a toothed portion 27A1, and the portion A2, which has no tooth, is referred to as a toothless portion 27A2. The tooth 27*a*, or the first tooth of the multiple teeth of the first gear 27A, is on the immediately downstream side of the toothless portion 27A2 of the first gear A2, in terms of the rotational direction of the partially toothed gear 27. In terms of the rotational direction, the first gear 27A of the partially toothed gear 27 described above has a portion A2 having no tooth with which it meshes with the driven gear 30. That is, it has a toothless portion 27A2.

Referring to part (b) of FIG. 3, this tooth 27*a* of partially toothed gear 27 has a surface 27*a*1 which comes into contact with the tooth 30*a* of the driven gear 30. This surface 27*a*1 of the tooth 27*a* is shaped so that points T1, T2 and T3 of contact, at which the tooth 27*a* of the partially toothed gear 27 comes into contact with the tooth 30*a* of the driven gear 30, is on the partially toothed gear side (first gear side), of a line of action L shown in part (b) of FIG. 3. Here, the line of action L is such a line that coincides with points P1, P2 and P3, at which the tooth 27*f* (FIG. 2), or the second tooth of the first gear 27A, which is on the immediately downstream side of the tooth 27*a* in terms of the rotational direction of the partially toothed gear 27, comes into contact with the tooth 30*a* of the driven gear 30. By the way, the points P1, P2 and P3 of contact are also the points of contact at which a tooth 30*a* of the driven gear 30 contacts the tooth 27*f*, or the second tooth of the partially toothed gear 27. Further, this line of action L is tangential to both the base circle d1 of the partially toothed gear 27, and the base circle d2 of the driven gear 30. Referring to part (a) of FIG. 3, as the gears rotate, the points P1, P2 and P3 of contact, at which the tooth 27*f* of the partially toothed gear 27 contacts the tooth 30*a* of the driven gear 30, moves on this line of action L in the direction indicated by an arrow mark Xp in part (a) of FIG. 3. The direction indicated by the arrow mark Xp in part (a) of FIG. 3 is the direction in which the points P1, P2 and P3 of contact move. In other words, the sheet feeding apparatus is designed so that the point at which the teeth of the partially toothed gear 27 mesh with those of the driven gear 30 is on the first gear (having first tooth) side of the line which is tangential to both the base circle d1 of the partially toothed gear 27, or the first gear, and the base circle d2 of the driven gear 30, or the second gear, or the point at which the first tooth 27*a* of the first gear 27A begins to contact one of the teeth of the second gear is in the area on the first gear side. Therefore, the distance which the tooth 27*a*, or the first tooth, moves before it comes into contact with one of the teeth of the second gear, is longer than that in a conventional sheet feeding apparatus, and therefore, the second gear is slower in rotation. By the way, the base circles d1 and d2 are the bases of the involute curves. Their characteristics are determined by the base circle which serves as a reference to the gear size, and the size of pressure angle.

Further, regarding points T1, T2 and T3 at which the tooth 27*a*, or the first tooth of the partially toothed gear 27, contacts the tooth 30*a* of the driven gear 30, the more downstream a point T is, in terms of the rotational direction of the partially toothed gear 27, the closer it is to the partially toothed gear side (first gear side) of the aforementioned line of action L. More concretely, compared to the point T2 of contact between the teeth 27*a* and 30*a* contoured in solid lines in part (b) of FIG. 3, the point T3 of contact between the teeth 27*a* and 30*a* contoured by broken lines in part (b) of FIG. 3, are on the partially toothed gear side, with reference to the abovementioned line of action L. By the way, the points T1, T2 and T3 of contact are also points of contact at which the tooth 30*a* of the driven gear 30 contacts the tooth 27*a*, or the first tooth of the partially toothed gear 27. Further, referring to part (b) of FIG. 3, as the gears rotate, the points T1, T2 and T3 of contact between the tooth 27*a* of the partially toothed gear 27 and the tooth 30*a* of the driven gear 30, move in the direction indicated by an arrow mark Xt in part (b) of FIG. 3, in an area which is on the partially toothed gear side (first gear side) of the abovementioned line of action L. This direction indicated by the arrow mark Xt in part (b) of FIG. 3 is the direction in which the points T1, T2 and T3 move.

The pressure lever 28, which is a rotational force applying means, is rotatably supported by an unshown shaft put through a hole 28*a* of the pressure lever 28. Further, it is under the pressure generated by an unshown spring in the clockwise direction. The pressure lever 28 is in contact with the cam portion 27*b* of the partially toothed gear 27, and applies to the partially toothed gear 27, the rotational force for meshing the toothed portions 27A1 and 27B of the partially toothed gear 27 with the driving gear 26 and driven gear 30, respectively.

Referring to FIG. 1, the solenoid 29 which is an engaging member separably engages the partially toothed gear 27, in an area in which the toothless portions 27A2 and 27B2 of the partially toothed gear 27 oppose the driven gear 30.

A roller holder 24 is held so that it can be rocked about the feed roller 16. It holds the feed roller 16 and pickup roller 15, which are feeding means, and an unshown idler gear, which transmits the rotation of the drive shaft 31 to the pickup roller 15. A pick spring 32 generates friction between the pickup roller 15 and sheet S1 by pressing the pickup roller 15 upon the sheet S1 by the application of a preset amount of force to the pickup roller 15.

The separation roller 17 is kept pressed upon the feed roller 16 by an unshown spring. In the separation roller 17, a torque limiter 18 is provided so that the problem that one or more sheets S or recording medium are conveyed with the sheet S1 is prevented by the load generated by the torque limiter 18.

The conveyance guide 25 shown in FIG. 7 is curved in such a manner that it conveys the sheet S1 upward.

The sheet feeding apparatus is structured so that while the motor is rotating, the pair of conveyance rollers 20 and 21 which is a conveying means, always rotate. When the speed at which the sheet S is conveyed by the pair of conveyance rollers 20 and 21, which is conveying means, is Vt, and the speed at which the sheet S is conveyed by the pair of feed rollers 16 and 17, as a feeding means, is Vf, the relationship between the two conveyance speeds are set so that they are the same (Vt=Vf).

The description of a lifting mechanism for lifting the sheet feeder cassette 100 to its feeding position, in which the topmost sheet of the sheets S set in the cassette 100 contacts the pickup roller 15 is given as a part of the description of the third embodiment.

<Operation of Sheet Feeding Apparatus>

Next, referring to parts (a)-(d) of FIG. 4 and parts (a)-(d) of FIG. 5, the sheet feeding apparatus is described about its operation. Parts (a)-(d) of FIG. 4 are drawings for describing the operation of the driving force transmitting portion (driving force transmitting device) of the sheet feeding apparatus. Parts (a)-(d) of FIG. 5 are drawing for describing the sheet movement in the sheet feeding apparatus. Parts (a)-(d) of Figure correspond in operational timing to parts (a)-(d) of Figure, respectively.

Part (a) of FIG. 4 is a state of sheet feeding apparatus before a print signal is inputted, and in which driving force transmitting portion (driving force transmitting device) is in its home position; the flapper 29*a* is in engagement with the engaging portion 27*c* of the partially toothed gear 27; and the partially toothed gear 27 is remaining stationary. When the sheet feeding apparatus is in this state shown in part (a) of FIG. 4, the toothless portion 27B2 of the second gear 27B of the partially toothed gear 27 is in a position in which it opposes the driving gear 26, and therefore, it does not occur that the rotation of the driving gear 26 is transmitted to the partially toothed gear 27. The toothless portion 27A2 of the first gear 27A of the partially toothed gear 27 is in a position in which it opposes the driven gear 30. The pressure lever 28 is in contact with a cam portion 27*b*, applying to the partially toothed gear 27, the force for rotating the partially toothed gear 27 in the clockwise direction. However, the flapper 29*a* of the solenoid 29 is in engagement with the engaging portion 27*c* of the partially toothed gear 27 as described above. Therefore, the partially toothed gear 27 is remaining stationary; it does not rotate. Therefore, the driving force is not transmitted to the feed roller 16. Therefore, the sheet S1 has not advanced at all from the position in which it was when it had been placed on the sheet holding plate.

As a print signal is inputted, a motor (FIG. 1) begins to rotate, and the flapper 29*a* of the solenoid 29 is pulled away, being thereby disengaged from the engaging portion 27*c* of the partially toothed gear 27, as shown in part (b) of FIG. 4; the flapper 29*a* is disengaged from the engaging portion 27*c*. Consequently, the partially toothed gear 27 begins to be rotated in the clockwise direction by the force it has been receiving from the pressure lever 28. As the partially toothed gear 27 rotates, the tooth 27*d* of the second gear 27B of the partially toothed gear 27 meshes with the driving gear 26, whereby the rotational driving force of the driving gear 26 is transmitted to the partially toothed gear 27. Thereafter, the tooth 27*e* of the first gear 27A of the partially toothed gear 27 meshes with the driven gear 30, causing thereby the driven gear 30 to rotate. Thus, the pickup roller 15 and feed roller 16 begin to rotate to feed the sheet S1 into the main assembly of the image forming apparatus as shown in part (b) of FIG. 5.

As the partially toothed gear 27 is continuously rotated, the area in which the partially toothed gear 27 and driven gear 30 are in engagement with each other, comes close to the toothless portion 27A2 of the first gear 27A of the partially toothed gear 27, as shown in part (c) of FIG. 4. As for the sheet S1, its leading edge moves past the curved conveyance guide 25, and reaches the pair of conveyance rollers 20 and 21, as shown in part (c) of FIG. 5. Therefore, the sheet S1 slackens in the area between the pair of conveyance rollers 20 and 21, and the pair of feed rollers 16 and 17.

As the partially toothed gear 27 is further rotated so that only the last tooth 27*a* of the toothed portion 27A1 of the first gear 27A of the partially toothed gear 27 is in contact with the driven gear 30, the driven gear 30 begins to smoothly decelerate in a period between when the sheet feeding apparatus is in the state shown in part (c) of FIG. 4 and when it is in the state shown in part (d) of FIG. 4. Then, the two gears 27 and 30 disengage from each other. Thus, the driven gear 30 stops rotating. Referring to part (c) of FIG. 4, the tooth 27*a*, or the first tooth of the multiple teeth of the toothed portion 27A1 of the first gear 27A is next to the toothless portion 27A2, which is the toothless area, in terms of the rotational direction of the partially toothed gear 27. The tooth 27*a*, which is one of the teeth of the partially toothed gear 27, is smaller in cross-section which is perpendicular to a line which coincides with the center 27*o* of the rotation of the partially toothed gear 27, than the other teeth of the partially toothed gear 27, which are the same in shape. More concretely, referring to part (c) of FIG. 4, the tooth 27*a* of the partially toothed gear 27 lacks a part of its surface with which it contacts the driven gear 30. It is smaller in cross-section than a tooth 27*f* of the partially toothed gear 27, which is the same in shape as the other teeth of the partially toothed gear 27. The driven gear 30 smoothly decelerates while it is in contact with only the tooth 27*a*, which is the most downstream tooth of the multiple teeth of the partially toothed gear 27, in terms of the rotational direction of partially toothed gear 27. As the driven gear 30 smoothly decelerates, both the pickup roller 15 and feed roller 16 which are in connection to the driven gear 30, also smoothly decelerate. The pair of conveyance rollers 20 and 21 convey the sheet S1 at a conveyance speed Vt, even while the pickup roller 15 and feed roller 16 smoothly decelerate. Therefore, the slacking of the sheet S1 is eliminated by the difference in conveyance speed between the pair of conveyance rollers 20 and 21, and the pair of feed rollers 16 and 17. Then, as the meshing between the driven gear 30 and partially toothed gear 27 is dissolved, the driven gear 30 stops rotating. As the driven gear 30 stops rotating, both the pickup rollers 115 and feed roller 16 which are in connection (engagement) with the driven gear 30 also stop rotating. The sheet feeding apparatus is designed so that the slacking of the sheet S1 is eliminated by the time when the pickup roller 15, and the pair of feed rollers 16 and 17, stop.

Regarding the driving force transmitting portion, the partially toothed gear 27 is rotated further in the clockwise direction by the force from the pressure lever 28, after the separation of the tooth 27*h* of the second gear 27B of the partially toothed gear 27 from the driving gear 26. The partially toothed gear 27, which is rotated by the force of the pressure lever 28, is stopped by the engaging portion 27*c* of the partially toothed gear 27, in its home position shown in part (a) of FIG. 4, as the flapper 29*a* of the solenoid 29 engages with the engaging portion 27*c* of the partially toothed gear 27. Thereafter, the sheet S1 is conveyed further by the conveyance force of the pair of conveyance rollers 20 and 21, through the passage described in a part of the description of the overall structure of the printer 90, ending the process of outputting a single print.

FIG. 6 is a graph which shows the relationship among the timing with which the pair of feed rollers 16 and 17 are turned on or off, the timing with which the pair of conveyance rollers 20 and 21 are turned on or off, and the changes in the amount of the slacking of the sheet S1. Parts (a)-(d) of FIG. 6 correspond in operational timing to parts (a)-(d) of FIG. 4 and parts (a)-(d) of FIG. 5, respectively.

Referring to FIG. 6, after the rotation of the pair of feed rollers 16 and 17 begins at timing (b), the sheet S1 increases in the amount of slack. Then, the amount of slack of the sheet S1 reaches its maximum just before the timing (c), with which the leading edge of the sheet S1 reaches the pair of conveyance rollers 20 and 21. As the pair of feed rollers 16 and 17 begin to decelerate at a timing (c), the sheet S1 gradually reduces in the amount of its slack. Then, the sheet S1 becomes zero in the amount of slack before the pair of feed rollers 16 and 17 stop with timing (d).

In a case where the driving force transmitting portion in this embodiment is not used, and the relationship between the conveyance speed Vt of the pair of feed rollers 16 and 17, and that Vf of the pair of conveyance rollers 20 and 21, is: Vt=Vf, the pair of feed rollers 16 and 17 suddenly reduces in conveyance speed from Vf to zero while the sheet S1 is remaining slack. Therefore, the sheet S1 is suddenly tensioned, generating therefore a large tensioning noise. On the other hand, in a case where the driving force transmitting portion in this embodiment is used, the slack of the sheet S1 will have been gone at the point when the pair of feed rollers 16 and 17 stop. Therefore, it does not occur that the sheet S1 generates a substantial noise when the pair of feed rollers 16 and 17 stop.

Further, in a case where the sheet feeding apparatus is structured so that the sheet S1 does not slacken between the pair of feed rollers 16 and 17 and the pair of pair of conveyance rollers 20 and 21 as in the case of a conventional sheet feeding apparatus, the following occurs. That is, in a case where a sheet feeding apparatus is structured so that the relationship between the conveyance speed Vf of the pair of feed rollers 16 and 17 and the conveyance speed Vt of the pair of conveyance rollers 20 and 21 is: Vf<Vt, the sheet feeding apparatus increases in sheet interval while the sheet S1 reaches the pair of conveyance rollers 20 and 21. Therefore, this control is disadvantageous from the standpoint of energy conservation. In comparison, in the case of this embodiment, the aforementioned relationship in conveyance speed is: Vt=Vf. Therefore, it does not occur that the sheet feeding apparatus increases in sheet interval. Therefore, the control in this embodiment is advantageous from the standpoint of energy conservation.

As described above, according to this embodiment, it is possible to prevent the problem, while conserving energy.

Embodiment 2

Next, referring to FIGS. 8 and 9, the driving force transmitting portion (driving force transmitting device) in the second embodiment of the present invention is described. FIG. 8 is a sectional view of the driving force transmitting portion of the sheet feeding apparatus in the second embodiment. FIG. 9 is a graph which shows the angular velocity of the driven gear of the sheet feeding apparatus in the second embodiment. The second embodiment is different from the first one only in the shape of certain teeth of the partially toothed gear 27. Thus, the portions of the driving force transmitting device in this embodiment, which are similar to the counterparts in the first embodiment, are not described; only the portions which are different from the counterparts are described.

In the description of the first embodiment given above, only the tooth 27*a*, or the first tooth, which is one of the multiple teeth of the partially toothed gear 27, by which the partially toothed gear 27 meshes with the driven gear 30, was described about its structure. However, the first embodiment is not intended to limit the present invention in scope in terms of the structure of the partially toothed gear 27. Referring to FIG. 8, in this embodiment, a tooth 27*i*, as the first tooth, is one of the multiple teeth of the partially toothed gear 27, with which the partially toothed gear 27 meshes with the driven gear 30. As in the first embodiment described above, the tooth 27*i* of the partially toothed gear 27 is smaller in cross-section which is perpendicular to the line 27*g* (FIG. 1) which coincides with the center 27*o* of rotation of the partially toothed gear 27, than the other teeth which are the same in shape. The partially toothed gear 27, or the first gear, has a pair of third teeth in addition to the tooth 27*i*, or the first tooth. The third teeth are on the immediately upstream side of the tooth 27*i* in terms of the rotational direction of the partially toothed gear 27. In this embodiment, the partially toothed gear 27 is provided with two teeth 27*j* and 27*k* as the third teeth. The tooth 27*i*, or the first tooth, of the toothed portion of the partially toothed gear 27, which has multiple teeth, and the two teeth 27*j* and 27*k*, or the third teeth, are on the immediately downstream side of the toothless portion 27A2, which is the toothless area, in terms of the rotational direction of the partially toothed gear 27. These three teeth 27*i*, 27*j* and 27*k* are different in shape and size from the tooth 27*f*, which is the second tooth and is on the immediately upstream side of the tooth 28*i* in terms of the rotational direction of the partially toothed gear 27. The tooth 2*i* which is the first tooth of the partially toothed gear 27, and the teeth 27*j* and 27*k* which are the third teeth of the partially toothed gear 27, are shaped so that the partially toothed gear 27 causes the driven gear 30 to decelerate earlier than an ordinary gear, the teeth of which are the same in shape and size. Like the tooth 27*a*, or the first tooth in the first embodiment described above, the teeth 27*i*, 27*j* and 27*k* of the partially toothed gear 27 have surfaces 27*i*1, 27*j*1 and 27*k*1, respectively, which come into contact with one of the teeth of the driven gear 30. The surfaces 27*i*1, 27*j*1 and 27*k*1 are shaped so that their points of contact with the teeth of the driven gear 30, one for one, are in an area which is on the partially toothed gear side (first gear side) of the line of action. Here, the line of action is a line of action L shown in part (b) of FIG. 3. The line of action L is such a line that connects the points at which the tooth 27*f*, or the second tooth, which is next to the tooth 27*i* in terms of the rotational direction of the partially toothed gear 27, comes into contact with one of the teeth of the driven gear 30, in the moving direction of the points of contact. Further, the line of action L is such a line which is tangential to both the base circle of the partially toothed gear 27 and that of the driven gear 30 (part (b) of FIG. 3). Further, regarding the relationship in height (h1, h2 and h3), or the dimension from their bottom end to their tip, among the teeth 27*i*, 27*j* and 27*k* of the partially toothed gear 27, the closer they are to the portion 27A2, or the toothless portion of the partially toothed gear 27, the less they are (h1>h2>h3).

FIG. 9 is a graph which shows the angular velocity of the driven gear 30. In the case of the comparative sheet feeding apparatus, the multiple teeth (toothed portion) of the partially toothed gear 27, which mesh with the driven gear 30, are normal in shape, and are the same in shape. That is, in the case of the comparative sheet feeding apparatus, at least one of the multiple teeth of the partially toothed gear 27, which mesh with the driven gear 30, more specifically, the one which is next to the toothless portion of the partially toothed gear 27, is not different in shape from the other teeth; it is the same in shape as the other. In the case of a sheet feeding apparatus such as the comparative sheet feeding apparatus, the multiple teeth of the partially toothed gear 27 are normal in shape and are the same in shape, the driven gear 30 is very quickly decelerated as indicated by a single-dot chain line in FIG. 9.

In comparison, referring to FIG. 4, in the case of the sheet feeding apparatus in the first embodiment, the tooth 27*a* which is the first tooth of the multiple teeth of the partially toothed gear 27, or the tooth next to the toothless portion 27A2 of the partially toothed gear 27, is different in shape from the other teeth, and its surface (contacting surface) is shaped as described above. Therefore, the driven gear 30 begins to smoothly decelerate earlier timing than the driven gear (30) of the comparative sheet feeding apparatus, as indicated by a broken line in FIG. 9.

Referring to FIG. 8, among the multiple teeth which the partially toothed gear 27 has, the tooth 27*i* which is the first tooth, or the tooth next to the toothless portion 27A2, and the teeth 27*j* and 27*k* which are the third teeth of the partially toothed gear 27, are different in shape from the tooth 27*f*, or one of the other teeth of the partially toothed gear 27; they have a surface (contacting surface) shaped as described above. Therefore, the partially toothed gear 27 in this embodiment can begin the deceleration of the driven gear 30 earlier than even the partially toothed gear 27 in the first embodiment, as indicated by a solid line in FIG. 9. Therefore, the second embodiment can rid a sheet of recording medium of a greater amount of slack than the second embodiment, as indicated by the solid line in FIG. 9.

By the way, in the second embodiment, the sheet feeding apparatus is structured to decelerate the driven gear 30 by the adjacent three teeth 27*i*, 27*j* and 27*k*. Therefore, the play (backlash) which occurs between the contacting surfaces of the adjacent two teeth, as the partially toothed gear 27 and driven gear 30 mesh with each other, sometimes causes a phenomenon that the driven gear 30 suddenly increases in angular velocity, in the area in which the tooth 27*i*, for example, separates from one of the teeth of the driven gear 30, and comes into contact with the next tooth of the driven gear 30. This phenomenon, however, does not have harmful effects upon the operation of the sheet feeding apparatus. Therefore, the second embodiment of the present invention is not problematic.

This embodiment also can prevent a sheet of recording medium from generating a large tensing noise as it is tensioned between the pair of feed rollers 16 and 17 and the pair of conveyance rollers 20 and 21, while conserving energy, like the embodiments described above.

Embodiment 3

Next, referring to FIG. 10 and parts (a)-(d) of FIG. 11, the driving force transmitting portion (driving force transmitting device) in the third embodiment of the present invention is described. In the third embodiment, the present invention was applied to the mechanism for lifting a sheet of recording medium to the position from which the sheet is fed into the main assembly of the image forming apparatus. That is, the present invention was applied to the driving force transmitting portion (driving force transmitting device) for transmitting driving force to the sheet lifting plate as a sheet bearing means.

Referring to FIG. 10, the driving force transmitting portion as a driving force transmitting device is provided with a driving gear 37, a partially toothed gear 35 as the first gear, a driven gear 38 as the second gear, a rocking arm 33, and a locking arm 34 as an engaging means, a pressure lever 36 as a rotational force applying means, etc.

The lifting mechanism is such a mechanism that raises the sheet holding plate 22 to place the top sheet on the sheet holding plate 22 (FIG. 7) in contact with the pickup roller 15 (FIG. 15) when the top sheet is positioned below the position from which it is to be fed into the main assembly of the image forming apparatus. It stops raising the sheet holding plate as the top sheet comes into contact with the pickup roller 15 (as top sheet is properly positioned in terms of the vertical direction). More concretely, the sheet holding plate 22 is raised by the operation of a lifting plate 23 (FIG. 7) which receives driving force from the driving force transmitting portion (driving force transmitting device) which will be described next.

<Structure>

FIG. 10 is a perspective view which shows the lifting mechanism. Referring to FIG. 10, the rocking arm 33 is rockably held by an unshown shaft put through the hole 33*a* of the arm 33, with which one of the lengthwise end portions of the rocking arm 33 is provided. The other end portion of the rocking arm 33 is in connection to the roller holder 24. The rocking arm 33 is rockably attached to an unshown shaft put through its connective hole 34*a*. Thus, as the other end portion 33*c* of rocking arm 33 moves upward, the locking arm 34 is lifted. The locking arm 34 is an engaging member which can engage with, or disengage from, the partially toothed gear 35, where the toothless portion of the partially toothed gear 35 oppose the driving gear 37 and driven gear 38.

Referring again to FIG. 10, the driving gear 37 is such a driving gear that is in connection to a motor as a driving force source. The driven gear 38 which is the second gear is in connection to the lifting plate 23 (lifting mechanism), shown in FIG. 7, by way of an unshown gear train. The driven gear 38 is a driven gear is meshed with the partially toothed gear 35 as the first gear. It rotates by receiving driving force from the partially toothed gear 35. A one-way clutch 39 rotates with the driven gear 38. With the presence of the one-way clutch 39, the driven gear 38 is allowed to rotate only in the clockwise direction; it is not allowed to rotate in the counterclockwise direction. The lifting plate 23 is held in such a manner that it is allowed to rock about its axle 23*a*, relative to the printer 90. It is a lifting mechanism for lifting the sheet holding plate 22, as a sheet bearing means, toward the pickup roller 15, which is a sheet feeding means. The one-way clutch 39 is structured to be allowed to rotate in only one direction, that is, the direction to lift the sheet holding plate 22. It transmits driving force to the lifting plate 23. The driven gear 38 is in connection to the lifting plate 23 by way of the one-way clutch 39.

The partially toothed gear 35, which is the first gear, has multiple teeth. It rotates by meshing with the driving gear 37. The partially toothed gear 35, or the first gear, is meshed with the driven gear 38 which is the second gear. It is a driving force transmitting gear which gives driving force to the driven gear 38. The partially toothed gear 35 has a portion which has no tooth, with which it meshes with other gears. The partially toothed gear 35 is a two-piece gear which has the first gear 35A (small gear) and the second gear 35B (large gear). The first gear 35A has a toothed portion 35A1 and a toothless portion 35A2. The toothed portion 35A1 has multiple teeth, by which it meshes with the driven gear 38, whereas the toothless portion 35A2 does not have any tooth, with which it meshes with the driven gear 38. The second gear 35B has a toothed portion 35B1 and a toothless portion 35B2. The toothed portion 35B1 has multiple teeth, with which it meshes with the driving gear 37, whereas the toothless portion 35B2 does not have any tooth, with which it meshes with the driving gear 37.

Referring to FIG. 10, the partially toothed gear 35, described above, has a cam 35*b*, and an engaging portion 35*c*, with which the tip portion of the locking arm 34 engages. A tooth 35*a*, as the first of the multiple teeth of the partially toothed gear 35, is different in shape from the other teeth of the partially toothed gear 35. The tooth 35*a*, or the first tooth of the partially toothed gear 35, is shaped so that the partially toothed gear 35 begins to decelerate the driven gear 38 with earlier timing than a partially toothed gear (35), all the teeth of the toothed portion (35*a*1) of which are the same in shape. Referring to an enlarged cross-sectional view of the teeth 35*a* and 35*f* of partially toothed gear 35, which is surrounded by a single-dot chain line in FIG. 10, the surface of the tooth 35*a* of the partially toothed gear 35, which comes into contact with one of the teeth of the driving gear 37, is given a smooth R-shaped (smooth and protrusive) curvature which makes the surface of the tooth 35*a* smaller than that of the normally shaped (involuted) gear of the partially toothed gear 35.

By the way, it is not mandatory that the tooth 35*a* of the partially toothed gear 35 is shaped so that its surface by which it contacts one of the teeth of the driving gear 37 has the smooth R-shape curvature, as it is seen from the direction parallel to the axial line of the partially toothed gear 35. For example, it may be shaped so that in cross-section, it appears straight or splined; it is optional. Further, it is not mandatory that the normally shaped teeth of the partially toothed gear 35 are shaped so that their surfaces with which they contact the tooth 35*a* of the partially toothed gear 35, appear involuted. For example, their contour may appear involuted, cycloidal; they are optional.

As for the shape of the tooth 35*a*, or the first tooth of the partially toothed gear 35, it is the same as that of the tooth 27*a*, which is the first gear of the partially toothed gear 27 in the first embodiment described above with reference to FIG. 2 and parts (a) and (b) of FIG. 3. Therefore, it is not described here. By the way, referring to FIG. 10, the tooth 35*f*, which is the second tooth of the partially toothed gear 35, is such a tooth of the partially toothed gear 35, which is next to the tooth 35*a* in terms of the rotational direction of the partially toothed gear 35.

The pressure lever 36 which is a rotational force applying means is rotatably attached to an unshown shaft; the shaft is put through the hole 36*a* of the pressure lever 36. It is under the pressure generated by an unshown spring in the counterclockwise direction. It is in contact with the cam 35*b* of the partially toothed gear 35. It applies to the partially toothed gear 35, the rotational force for causing the toothed portions 35A1 and 35B1 of the partially toothed gear 35 engage with the driven gear 38.

<Operation of Lifting Mechanism>

Next, referring to FIG. 11, the operation of the lifting mechanism of the sheet feeding apparatus is described. Parts (a)-(d) of FIG. 11 are drawings for describing the operation of the lifting mechanism of the sheet feeding apparatus.

Part (a) of FIG. 11 is a side view of the lifting mechanism when the sheets on the sheet holding plate 22 has lifted the pickup roller high enough for the top sheet S to be in the position from which the sheet can be fed into the main assembly of the image forming apparatus. One end 33*c* of the rocking arm 33 is on the lower side in a range in which it is rockable. The end of the locking arm 34 has not been lifted by the end portion 33*c* of the rocking arm 33, remaining in engagement with the engaging portion 35*c* of the partially toothed gear 35. Therefore, the partially toothed gear 35 is remaining stationary. When the sheet feeding apparatus is in this state, the toothless portion 35B2 of the second gear 35B of the partially toothed gear 35 is in a position in which it opposes the driving gear 37. Therefore, it does not occur that the rotation of the driving gear 37 is transmitted to the partially toothed gear 35. The toothless portion 35A2 of the first gear 35A of the partially toothed gear 35 is in a position in which it opposes the driven gear 38. The pressure lever 36 is in contact with the cam 35*b*. Thus, it applies to the partially toothed gear 35, the force for rotating the partially toothed gear 35 in the counterclockwise direction. However, the tip of the locking arm 34 is in engagement with the engaging portion of the partially toothed gear 35, as described above. Therefore, it does not occur that the partially toothed gear 35 rotates; the partially toothed gear 35 remains stationary.

As a print signal is inputted, the top sheet of the multiple sheets S on the sheet holding plate 22 is fed into the main assembly of the image forming apparatus. As the top sheet is fed, the top surface of the stack of sheets on the sheet holding plate lowers. As the top surface of the stack of sheets lowers, the roller holder 24 shown in FIG. 10 rocks in the counterclockwise direction. Therefore, one end 33*c* of the rocking arm 33 lifts the locking arm 34. As the number of the outputted prints reaches roughly 10, the tip of the locking arm 34 disengages from the engaging portion 35*c*. Thus, the partially toothed gear 35 begins to be rotated in the counterclockwise direction by the force it has been receiving from the pressure lever 36. As the partially toothed gear 35 rotates, the tooth 35*d* of the second gear 35B of the partially toothed gear 35 comes into contact with one of the teeth of the driving gear 37. Thus, the rotational driving force from the driving gear 37 is transmitted to the partially toothed gear 35. Thereafter, the tooth 35*e* of the first gear 35A of the partially toothed gear 35 comes into contact with one of the teeth of the driven gear 38, causing driven gear 38 to rotate, as shown in part (b) of FIG. 11. As a result, the lifting plate 23, shown in FIG. 7, pivots in the counterclockwise direction. Thus, the sheet holding plate 22 begins to lifted; the sheets S begin to be lifted.

As the rotation of the partially toothed gear 35 continues, the lifting of the stack of sheets S continues, as shown in part (c) of FIG. 11, causing the one end 33*c* of the rocking arm 33 lowers. Eventually, only the first tooth 35*a* of the toothed portion 35A1 of the first gear 35A is in contact with the driven gear 38, causing the driven gear 38 to decelerate as shown in parts (c) and (d) of FIG. 11. The last tooth 35A2 of the toothed portion 35A1 of the first gear 35A is such a tooth that belongs to the toothed portion 35A1, and is next to the toothless portion 35A2 in terms of the rotational direction of the partially toothed gear 35, as shown in part (c) of FIG. 11. As the driven gear 38 begins to decelerate, the lifting plate 23, which is in connection to the driven gear 38, also begins to smoothly decelerate. Then, the driven gear 38 ceases rotating, as it disengages from the partially toothed gear 35. Thus, it stops rotating. As it stops rotating, the lifting plate which is in connection to the driven gear 38, also stops.

After the tooth 35*h* of the second gear 35B of the partially toothed gear 35 separates from the driving gear 37, the partially toothed gear 35 is rotated further in the counterclockwise direction by the force of the pressure lever 36. As the partially toothed gear 35 is rotated by the force of the pressure lever 36, the tip of the locking arm 34 engages with the engaging portion 35*c* of the partially toothed gear 35, in the home position shown in part (a) of FIG. 11. Thus, the partially toothed gear 35 stops. Because of the effects of the one-way clutch 39, it does not occur that the driven gear 38 is rotated in the counterclockwise direction by the weight of the stack of sheets S, sheet holding plate 22, etc. Therefore, it does not occur that the stack of sheets S descends.

In the foregoing description of this embodiment, as the partially toothed gear 35 rotates once, the top sheet S of the stack of sheets rises the printing position. However, during the lifting operation which occurs right after the setting of sheets S in the sheet feeder cassette 100 shown in FIG. 7, the sheet holding plate 22 will have descended to its bottommost position. Therefore, the partially toothed gear 35 rotates twice or more until the top sheet S climbs to the printing position.

In a case where the driving force transmitting portion in this embodiment is not in use, that is, in a case where all the multiple teeth (toothed portion) of the partially toothed gear 35, with which the partially toothed gear 35 meshes with the driven gear 38, are the same in shape (normal shape) (comparative sheet feeding apparatus), the lifting of the sheets S suddenly stops between when the driving force transmitting portion is in the state shown in part (c) of FIG. 11 and when it is in the state shown in part (d) of FIG. 11. Thus, a phenomenon that the stack of sheets S, or a combination of the stack of sheets S and sheet holding plate 22 (FIG. 7), is slightly floated in the air by inertia, occurs; a gap occurred between the one-way clutch 39 of the lifting mechanism and the stack of sheets S. Thus, as the stack of sheets S, and/or the sheet holding plate 22, which was in the air, fell due to their own weight (as gap disappeared), a banging sound occurred. In comparison, in a case where the driving force transmitting portion in this embodiment is used, the driven gear 38 is smoothly decelerated until it stops. Therefore it does not occur that the stack of sheets S, and/or the combination of the stack of sheets S and sheet holding plate 22, floats in the air. Therefore, the banging noise does not occur.

As described above, this embodiment can prevent the problem that an image forming apparatus generates a banging noise attributable to a phenomenon that as a stack of sheets, and/or a combination of the stack of sheets and a sheet holding plate, slightly floats due to inertia, while conserving energy.

Embodiment 4

In the three embodiments described above, the driving force transmitting portion was structured so that the partially toothed gear, or the first gear, functions as the driving force transmitting gear which applies driving force to the second gear which is meshed with the first gear, whereas the second gear which was meshed with the partially toothed gear, or the first gear, was the driven gear which rotated by receiving driving force from the partially toothed gear. Further, one or more teeth of the partially toothed gear (first gear) were made different in shape from the other teeth of the partially toothed gear, in order to decelerate the driven gear, as the second gear, which was meshed with the partially toothed gear, or the first gear. That is, the driving force transmitting portion was structured so that the driven gear, or the downstream gear in terms of the driving force transmission direction, was reduced in rotational speed while the partially toothed gear was rotated at a constant speed.

In this embodiment, the driving force transmitting portion was structured so that the partially toothed gear, which is the first gear, functions as a driven gear which rotates by receiving driving force from the second gear which is meshed with the first gear, whereas the second gear which is meshed with the partially toothed gear, or the first gear, functions as a driving gear which is driving force transmitting gear which give driving force to the partially toothed gear. Further, one or more of the teeth of the partially toothed gear, or the first gear, was made different in shape from the other teeth of the partially toothed gear to decelerate the partially toothed gear itself, or the first gear, which rotates by receiving driving force from the driving gear, or the second gear. That is, in this embodiment, the driving gear rotates at a constant speed, and the partially toothed gear, or the downstream gear, reduces itself in rotational speed.

That is, this embodiment is different from the preceding embodiments in that in the preceding embodiment, the partially toothed gear rotated at a constant speed, whereas in this embodiment, the partially toothed gear changed in speed. Hereafter, this embodiment is described. However, the portions of this embodiment, which are the same as the counterparts in the preceding embodiments, are not described; only the portions which are different from the counterparts, are described.

To being with, referring to FIG. 14 and parts (a) and (b) of FIG. 15, the sheet feeding apparatus in this embodiment is described about its overall structure.

FIG. 14 is a sheet feeding apparatus in this embodiment, which is similar to the one in the first embodiment, but has a driving force transmitting portion which is in accordance with the present invention. That is, the drive shaft 31, pickup roller 15, feed roller 16, separation roller 17, pickup spring 32, and roller holder 24, shown in FIG. 14, are the same in shape and function as those shown in FIG. 1.

What makes this embodiment different from the preceding embodiments is the driving force transmitting portion, as a driving force transmitting device, of the sheet feeding apparatus in this embodiment, shown in FIG. 14. The driving force transmitting portion in this embodiment has: a driving gear 40, a trigger gear 41, a connective gear 42, a driven gear 43, a pressure lever 44, a solenoid 46, etc.

Referring to FIG. 14, the driving gear 40, as the second gear, is driven by a motor. It is a fully toothed wheel for transmitting driving force. Here, the second gear is a driving gear which is driven by the motor. This embodiment, however, is not intended to limit the present invention in terms of the second gear. The second gear is a driving force transmitting gear for transmitting driving force. The driving gear is included in a group of driving force transmitting gear. The driving gear 40 transmits driving force to the connective gear 42 by being in mesh with the connective gear 42 as the first gear. As the driving gear 40 receives driving force from the motor, it continuously rotates in the direction indicated in FIG. 14 at a constant speed. The driving gear 40, or the second gear, is disposed so that the driving force is transmitted to the trigger gear 41 which is the third gear, as well as the connective gear 42, or the first gear. Here, the trigger gear 41 and connective gear 42 are coaxially supported by the same shaft, and are connected to each other by their shared internal spring, and catching portions. Hereafter, a combination of the trigger gear 41, connective gear 42, and internal springs is referred to as a partially toothed two-piece gear.

Although the detailed description of the operation of the partially toothed two-piece gear is given later, the partially toothed two-piece gear is controlled by the solenoid 45, making it possible for the two-piece gear to intermittently move. During the driving, the driving force is transmitted from the driving gear 40 to the driven gear 43 through the partially toothed two-piece gear, to rotate the driven gear 43.

Here, the connective gear 42, or the first gear, is such a driven gear that is meshed with the driving gear 40, or the second gear, and rotates by receiving the driving force from the driving gear 40. Unlike an ordinary gear, all the teeth of which are the same in shape, the connective gear 42 has teeth 42*h* and 42*i*, which lack a part of their surface, with which they mesh with the driving gear 40. That is, the connective gear 42 is equivalent to the partially toothed gear described above. The teeth 42*h* and 42*i* of the connective gear 42 are shaped to decelerate the connective gear 42, compared to the speed at which the other gears of the connective gear 42, which are the same in shape, rotate the connective gear 42. Therefore, when driving is stopped, the trigger gear 41 decelerates, mitigating thereby the banging sound which occurs as the engaging portion 41*k* of the trigger gear 41 bumps into the engaging portion 45*b* of the solenoid flapper 45*a* of the solenoid 45. This mitigation of the banging noise is what makes this embodiment different from the preceding embodiments. The details are described later.

Parts (a) and (b) of FIG. 15 are drawings of the partially toothed two-piece gear disassembled in the direction parallel to its rotational axis. Part (b) of FIG. 15 is what results as part (a) of FIG. 15 is rotated by 180□. It is a perspective view of the partially toothed two-piece gear viewed from an angle different from the angle from which the gear is viewed in part (a) of FIG. 15.

Referring to part (a) of FIG. 15, the trigger gear 41 is attached to the same shaft as the one to which the connective gear 42, or the first gear, is attached. It is the third gear, which rotates by receiving driving force from the connective gear 42. The trigger gear 41 and connective gear 42 have toothless portions 41*a* and 41*b*, respectively. They have also shaft holes 41*g* and 42*g*, respectively, and are rotatably supported by the same shaft put through the shaft holes 41*g* and 42*g*, respectively. The trigger gear 41 has a surface 42*d*, a spring seat 41, and a catching portion 41*f*. Similarly, the connective gear 42 has a toothless portion 42*a* and a toothed portion 42*b*, a surface 42*d*, a spring seat 42*e*, and a catching portion 42*f*, as shown in part (b) of FIG. 15. When the driving force transmitting portion is in the state shown in FIG. 14, the surface 41*d* and surface 42*d* are in contact with each other, positioning thereby the trigger gear 41 and connective gear 42 in terms of the direction parallel to the lengthwise direction of the shaft by which the two gears 41 and 42 are rotatably held. Also when the driving force transmitting portion is in the state shown in FIG. 14, the trigger gear 41 and connective gear 42 are under the force generated by an internal spring 46 disposed between the spring seats 41*e* and 42*e*. The internal spring 46 is a compression spring.

Further, referring to part (b) of FIG. 15, the trigger gear 41 has a cam portion 41*j*, which has an engaging portion 41*k*, which comes into contact with the solenoid 45. As for the connective gear 42, it has a surface 42*c* which looks like a letter D as seen from the direction parallel to the aforementioned shaft. The pressure lever 44 is in contact with the surface 42*c* of the cam portion 41*j*. The pressure lever 44 is rotatably held by an unshown shaft put through its shaft hole 44*a*. It is under a preset amount of torque generated by an unshown spring in a manner to rotate the connective gear 42 about the shaft by which it is held.

Next, referring to parts (a)-(d) of FIG. 16 and parts (a)-(e) of FIG. 17, the operation of the driving force transmitting portion in this embodiment is described.

FIG. 16 is a drawing of only the driving force transmitting portion in FIG. 14. Parts (a)-(e) of FIG. 16 correspond to the five distinctive stages through which driving force is transmitted by the driving force transmitting portion. Parts (a)-(e) of FIG. 17 are a combination of a sectional view of the driving force transmitting portion at a plane which coincides with the surface 42*d* of the cam portion 41*j*, a side view of the cam portion 41*j*, a side view of the driven gear 43, and a side view of the pressure lever 44. Parts (a)-(e) of FIG. 17 correspond to parts (a)-(e) of FIG. 16 in the state in which the driving force transmitting portion is in its operation.

Parts (a) of FIGS. 16 and 17 are drawings of the driving force transmitting portion when the partially toothed two-piece gear and driven gear 43 are remaining stationary. When the driving force transmitting portion is in the state shown in parts (a) of FIGS. 16 and 17, the toothless portion 41*a* of the trigger gear 41, and the toothless portion 42*a* of the connective gear 42, are facing the driving gear 40, and therefore, the driving force from the driving gear 40 is not transferred to the partially toothed two-piece gear. This position of the partially toothed two-piece gear is referred to as a home position. When the partially toothed two-piece gear is in the home position, the engaging portion 41*k* of the trigger gear 41 is in engagement with the engaging portion 45*b* of the solenoid flapper 45*a*, preventing thereby the connective gear 42 from being rotated by the torque from the pressure lever 44. Further, the internal spring 46 attached to the spring seat 41*e* of the trigger gear 41 by one end, and the spring seat 42*e* of the connective gear 42 by the other end is remaining compressed.

Next, parts (b) of FIGS. 16 and 17 are drawings of the driving force transmitting portion when the solenoid flapper 45*a* of the solenoid 45 (FIG. 14) has just been disengaged from the cam portion 41*j* of the trigger gear 41 by the solenoid 45, and therefore, the partially toothed two-piece gear has just begun to rotate. More specifically, as the solenoid flapper 45*a* is pulled by the solenoid 45, the internal spring is allowed to decompress (expand), causing the trigger gear 41 to rotate in the clockwise direction. Consequently, the first tooth of the toothed portion 41*b* engages with the driving gear 40. That is, the toothed portion 41*b* of the trigger gear 41 meshes with the driving gear 40. Thus, the trigger gear 41 begins to be driven by the driving gear 40. At this point in time, the connective gear 42 is remaining stationary. As for the driven gear 43, it is displaced from the trigger gear 41 in terms of the lengthwise direction of the shaft, being in engagement with only the connective gear 42. Therefore, the driven gear 43 also remains stationary.

Next, parts (c) of FIGS. 16 and 17 are drawings of the driving force transmitting portion when the partially toothed two-piece gear and driven gear 43 are being driven. As the trigger gear 41 begins to be driven while the driving force transmitting portion is in the state shown in parts (c) of FIGS. 16 and 17, the catching portion 41*f* of the trigger gear 41 comes into contact with the catching portion 42*f* of the connective gear 42. Thus, the driving force is transferred from the trigger gear 41 to the connective gear 42 by way of the catching portions 41*f* and 42*f*, causing the connective gear 42 to rotate. That is, the driving force transfers from the driving gear 40 to the connective gear 42 by way of the trigger gear 41. As a result, the connective gear 42 which is meshed with only the connective gear 42 is driven.

Next, parts (d) of FIGS. 16 and 17 are drawings of the driving force transmitting portion just before the trigger gear 41 engages with the solenoid flapper 45*a*. When the driving force transmitting portion is in the state shown in parts (d) of FIGS. 16 and 17, the toothless portion 41*a* of the trigger gear 41 is facing the driving gear 40, and the toothed portions 42*b* of the connective gear 42 is facing the driving gear 40. Therefore, the driving force from the driving gear 40 is transmitted to the connective gear 42, and then, is transmitted to the trigger gear 41 by the resiliency of the internal spring 46. That is, the speed with which the engaging portion 41*k* of the trigger gear 41 moves toward the engaging portion 45*b* of the solenoid flapper 45*a* is roughly the same as the rotational speed of the connective gear 42. At this point in the operational sequence of the driving force transmitting portion, the toothed portion 42*b* of the connective gear 42, which is facing the driving gear 40, has the teeth 42*h* and 42*i*, which are smaller than the other teeth of the connective gear 42. Further, the tooth 42*i* is smaller than the tooth 42*h*. Thus, the connective gear 42 is decelerated. Thus, the trigger gear 41, which receives the driving force from the connective gear 42, also decelerates, reducing the speed with which the engaging portion 41*k* of the trigger gear 41 moves toward the engaging portion 45*b* of the solenoid flapper 45*a*. Therefore, the banging noise which occurs as the engaging portion 41*k* of the trigger gear 41 comes into contact with the engaging portion 45*b* of the solenoid flapper 45*a* is substantially smaller than that which a conventional driving force transmitting portion causes. That is, this embodiment can provide a driving force transmitting portion which is significantly smaller in the banging noise which occurs as the engaging portion 41*k* of the trigger gear 41 comes into contact with the engaging portion 45*b* of the solenoid flapper 45*a*. By the way, when the driving force transmitting portion is in the state shown in parts (d) of FIGS. 16 and 17, the driven gear 43 is facing the toothless portion 42*a* of the connective gear 42, having already become stationary. Therefore, it does not occur that the driven gear 43 changes in speed while the driving force is transmitted.

Next, parts (e) of FIGS. 16 and 17 are drawings of the driving force transmitting portion right before the trigger gear 41 stops and the connective gear 42 rotates into its home position. As will be evident from the drawings, even after the trigger gear 41 stops, the connective gear 42 continues to rotate by receiving the driving force from the driving gear 40. As the connective gear 42 continues to rotate, the internal spring 46 between the spring seats 41*e* and 42*e* is gradually compressed. Then, as the last tooth of the toothed portion 42*b* of the connective gear 42 disengages from the driving gear 40, the torque from the pressure lever 44 is caught by the surface 42*c* of the cam portion 41*j*. Thus, the connective gear 42 is rotated back into its home position.

Next, referring to FIG. 18, the operational sequence of the driving force transmitting portion in this embodiment is described. Parts (a)-(e) of FIG. 18 correspond to parts (a)-(e) of FIG. 17 in operational timing.

As an operation to feed a sheet of recording medium into the main assembly of the image forming apparatus is started (S0), the solenoid flapper 45*a* is pulled by the solenoid 45 (S1). As the solenoid flapper 45*a* is pulled by the solenoid 45, the trigger gear 41 is made to engage with the driving gear 40 by the resiliency of the internal spring 46 (S2). Thus, the trigger gear 41 is driven by the driving gear 40 (S3). As the trigger gear 41 continues to be driven, the catching portion 41*f* of the trigger gear 41 comes into contact with the catching portion 42*f* of the connective gear 42, causing the connective gear 42 to begin to rotate (S4). As the driving of the connective gear 42 continues, the toothed portion 42*b* of the connective gear 42 meshes with the driven gear 43, beginning to drive the driven gear 43 (S5). As the meshing between the toothed portion 42*b* of the connective gear 42 and driven gear 43 ends, the driven gear 43 stops (S6). Then, as the toothless portion 41*a* of the trigger gear 41 faces the driving gear 40, the meshing between driving gear 40 and trigger gear 41 ends (Step 7). The driving force from the driving gear 40 is transmitted to the connective gear 42. Then, it is transmitted to the trigger gear 41 by way of the spring seats 41*e* and 42*e*, and internal spring 46 (Step 8). Next, as the diminutive teeth 42*h* and 42*i* of the connective gear 42 mesh with the driving gear 40, the connective gear 42 is reduced in speed relative to the driving gear 40, which rotates at a constant speed (S9). As the connective gear 42 is reduced in speed, the trigger gear 41 is reduced in speed. The trigger gear 41 comes into contact with the solenoid flapper 45*a* while being reduced in speed. Then, it stops (S10). As the meshing between the driving gear 40 and connective gear 42 ends, the connective gear 42 is returned to the home position by the pressure lever 44 (S11). In a case where another sheet S of recording medium needs to be fed, the feeding sequence is started again from Step S1. If it is unnecessary to feed another sheet S, the feeding sequence is ended (S13).

Next, referring to parts (a)-(e) of FIG. 19, parts (a)-(e) of FIG. 20 and parts (a)-(b) of FIG. 21, the structural arrangement for reducing the partially toothed gear in speed, which characterizes this embodiment, is described in detail.

Parts (a)-(e) of FIG. 19 are a combination of drawings which show the shape and operation of the gears of the comparative driving force transmitting portion. Part (a) of FIG. 19 is a drawing for showing overall shape of the driving gear 40, and the comparative connective gear 47. Parts (b)-(e) of FIG. 19 are enlarged drawings of the portion of the comparative driving force transmitting portion, in which the driving gear 40 meshes with the comparative connective gear 47. They are different by a preset angle in terms of the rotational phase of the driving gear 40. By the way, each black dot in the drawings represent one of the points of contact between the driving gear 40 and comparative connective gear 47.

As is evident from part (b)-(e) of FIG. 19 which show the points of contact between the driving gear 40 and connective gear 47 in the comparative driving force transmitting portion, all the points of contact between the driving gear 40 and connective gear 47 are on a straight line L2, which is tangential to both the base circle 40*x* of the driving gear 40 and the base circle 47*x* of the connective gear 47. Hereafter, this line is referred to as a line of action or an action line L2. In a case where both the driving gear and connective gear are involute in shape, all points of contact are on the action line L2, regardless of rotational angle of the driving gear (40) and connective gear (47). Further, as the driving gear (40) and connective gear (47) rotate, the points of contact change in position while remaining on the action line L2. Moreover, the number of points of contact changes between 1 and 2. That is, in the case of the comparative driving force transmitting portion, the points of contact between the connective gear 47 and driving gear 40 move on the line of action L2, while the connective gear 47 rotates at a constant speed like the driving gear 40 by receiving driving force from the driving gear 40 which rotates at a constant speed.

Further, θ47 in parts (b)-(e) of FIG. 19 is the angle of a tooth 47*h* of the connective gear 47 relative to a line L1 which coincides with the center of the driving gear 40 and that of the connective gear 47. In the case of a conventional driving force transmitting portion in which both the driving gear 40 and connective gear 47 are involute gears, as the driving gear 40 rotates at a constant speed, the connective gear 47 also rotates at a constant speed. That is, the angle 947 increases at a constant ratio relative to elapsed length of time.

Next, part (a) of FIG. 20 is a drawing for showing the shape and movement of the driving gear 40, and shape and movement of the connective gear 42, in this embodiment. Parts (b)-(e) of FIG. 20 are enlarged drawings of the area of meshing between driving gear 40 and connective gear 42. They show four states of the driving force transmitting portion, which the driving force transmitting portion goes through as it transmits driving force. By the way, parts (b)-(e) of FIG. 20 correspond to parts (b)-(e) of FIG. 19, respectively, in terms of the rotational phase of the driving gear 40.

Referring to part (b)-(e) of FIG. 20, the connective gear 42 in this embodiment has two (first and second) teeth 42*h* and 42*i*, which are not only smaller than the other teeth of the connective gear 42, but also, different in shape from the other. Further, the first tooth 42*h* is smaller than the second tooth 42*i*. Points of contact between the driving gear 40 and connective gear 42 are offset from the line of action L2.

To describe in greater detail, part (b) of FIG. 20 is a drawing of the area of meshing between the driving gear 40 and connective gear 42 shortly after the connective gear 42 began to reduce in speed. When the two gears 40 and 42 are meshed with each other as shown in part (b) of FIG. 2, the driving gear 40 is in contact with the tooth 42*m* of the connective gear 42. This point Pb of contact changes in position as if it is on a curved line Lb which curves away from the line of action L2. That is, the curved line Lb, as the second line of action, has such a curvature that the point Pb of contact between the driving gear 40 and the tooth 42*m* of the connective gear 42 moves away from the line L2 of contact, or the first line of contact, toward the driving gear 40, or the first gear. Then, as the driving gear 40 separates from the tooth 42*m*, the state of contact between the driving gear 40 and connective gear 42 becomes as shown in part (c) of FIG. 20, in which the driving gear 40 is in contact with the tooth 42*h* of the connective gear 42, or the larger of the aforementioned two smaller teeth of the connective gear 42, and the point of contact has moved from the point Pb to a point Pc. As the driving of the driving gear 40 continues, the state of meshing between the driving gear 40 and connective gear 42 becomes as shown in part (d) of FIG. 20, and the point Pc of contact moves on a curved line Ld, which has such a curvature that curves away from the line of action L2 toward the driving gear 40, like the curved line Lb. That is, the curved line Ld also is the second line of action like the curved line Lb, and has such a curvature that curves away from the line of action L2, or the first line of action, toward the driving gear 40, or the first gear.

Referring to parts (b)-(d) of FIG. 20, if the locus of the point of contact between the driving gear 40 and connective gear 42 has such a curvature that curves away from the line of action L2, toward the driving gear 40, on the downstream side (right-hand side in drawing), of the line L1, the connective gear 42 is reduced in speed. Thereafter, as the driving of the driving gear 40 continues, and the state of the area of meshing between the two gears 40 and 42 becomes as shown in part (e) of FIG. 20, the driving gear 40 does not contact the tooth 42*i*, or the second of the smaller teeth of the connective gear 42, and comes into contact with the tooth 42*j*, or the third smaller tooth of the connective gear 42. Thus, the point of contact moves to a point Pd. During the occurrence of this change in the state of meshing between the two gears 40 and 42, the connective gear 42 is increased in speed by an amount equivalent to the amount of rotational phase reduced by the reduction of the speed of the connective gear 42, which occurred through the sequential stages shown in part parts (b)-(e) of FIG. 20. The point Pd of contact, shown in part (e) of FIG. 20, between the third smaller gear 42*j* and the driving gear 40 is offset from the line of action L2. Therefore, the connective gear 42 is accelerated by an amount equivalent to the amount in terms of rotational phase by which the connective gear 42 is reduced in speed by the deceleration caused through the stages shown in parts (b)-(e) of FIG. 20. Then, as the rotation of the driving gear 40 continues, the point of contact moves back onto the line of action L2, and the connective gear 42 begins to rotate at the constant speed.

By the way, in this embodiment, the driving force transmitting portion was structured so that the connective gear 42 had the first, second, and third teeth 42*h*, 42*i* and 42*j*, respectively, which are different in shape from the other teeth of the connective gear 42, and also, are smaller than the other teeth. In this case, the driving force transmitting portion was structured so that as the rotation of the driving gear 40 continues, the driving gear 40 comes into contact with the first and third smaller teeth 42*h* and 42*j*, but does not come into contact with the second smaller tooth 42*i*. This embodiment, however, is not intended to limit the present invention in scope in terms of the structure of the driving force transmitting portion. For example, a driving force transmitting portion may be structured so that the connective gear 42 has the first and second teeth 42*h* and 42*i*, which are smaller than the other teeth of the connective gear 42, and are different in shape from the other gear, and the third gear 42*j* which is smaller than the other gear, but is involutely shaped like the other teeth. In this case, as the rotation of the driving gear 40 continues, the driving gear 40 comes into contact with the first tooth 42*h*, and then, the second tooth 42*i*. Then, it comes into contact with the involutely shaped tooth. Even if a driving force transmitting portion is structured as described above, it is effective to decelerate the connective gear as well as the one in this embodiment.

As described above, by structuring a driving force transmitting portion so that the locus of the point of contact between the driving gear 40 and connective gear 42 is on the downstream side (right-hand side in drawing), and curves toward the driving gear 40, it is possible to decelerate the connective gear 42. By the way, in parts (a)-(e) FIG. 20, the surface of each of the smaller and optionally shaped gears, by which the connective gear 42 comes into contact with the driving gear 40, are straight. However, as long as the locus of the point of contact between the driving gear 40 and connective gear 42 extends toward the driving gear 40, the surface may have such a curvature that appears like an arc (R-shaped) as seen from the direction parallel to the rotational axis of the connective gear 42; it may have an outwardly protrusive curvature.

By the way, as described above, the line of action L2 is the first line of action, which is such a line of action that if a driving force transmitting portion is structured so that the point of contact between the driving gear 40 and connective gear 42 is always on this first line of action, the connective gear 42 rotates at a constant speed. On the other hand, the curved lines Lb and Ld are the second lines of action, and are such curved lines that extends toward the driving gear relative to the aforementioned line of action L2. As described above, in this embodiment, the driving force transmitting portion has two or more lines of action, which are the loci of the point of contact between the driving gear 40 and connective gear 42.

Part (a) of FIG. 21 is a graph which shows the relationship among the rotational phase of the connective gear 42 in this embodiment, rotational phase of the comparative connective gear 47, and elapsed time, and part (b) of FIG. 21 is a graph which shows the relationship among the angular velocity of the connective gear 42 in this embodiment, angular velocity of the comparative connective gear 47, and elapsed time. By the way, t1-t4 in the graphs correspond to parts (b)-(e) of FIG. 19, and parts (b)-(e) of FIG. 20, respectively. As described above, the comparative connective gear 47 rotates at a constant angular velocity, and therefore, its rotational phase increases in proportion to the length of elapsed time. That is, it increases as indicated by a dotted straight line P47 in part (a) of FIG. 20. Further, the angular velocity of the comparative connective gear 47 remains stable at a certain value as indicated by a dotted line w47 in part (b) of FIG. 21.

On the other hand, the rotational phase P42 of the connective gear 42 in this embodiment is less than that of the comparative connective gear 47 between t1-t3, and recovers at t4, as shown in part (a) of FIG. 20. Therefore, the angular velocity w42 of the connective gear 42 is less than the angular velocity w47 of the comparative connective gear 47 as shown in part (b) of FIG. 20. Thus, the connective gear 42 is accelerated between t3-t4 by the amount equivalent to the amount by which it was slowed in rotational phase.

By causing the trigger gear 41 to collide with the solenoid flapper 45*a* during the period t2-t3 in which the connective gear 42 is reduced in speed, the connective gear 42 in this embodiment can reduce the speed at which the trigger gear 41 collides with the solenoid flapper 45*a*, compared to the comparative connective gear 47. Therefore, it can reduce a driving force transmitting portion in the sound of the collision described above.

Embodiment 5

This embodiment is such an embodiment that the structural arrangement, the fourth embodiment, for decelerating the partially tooth gear was applied to a driving mechanism which is different from the one in the fourth embodiment. Portions of the driving force transmitting portion in this embodiment, which are similar to the counterparts in the preceding embodiments are not described; only the portions which are not found in the driving force transmitting portions in the preceding embodiments are described.

Referring to FIG. 7, the image forming apparatus 90 has a fixing portion 10 for fixing an unfixed image to a sheet S of recording medium with the application of heat and pressure. The fixing portion 10 has: a fixation roller 10*b* for supplying the sheet S1 with primarily heat; and a pressure roller 10*b* for supplying the sheet S1 with primarily pressure. The pressure roller 10*a* is kept pressed upon the fixation roller 10*b* by roughly 5-10 kg of pressure generated by a strong spring. Thus, it is possible that if the image forming apparatus 90 is not used for a long period time, for example, while the power source of the image forming apparatus 90 is off or the like period, the pressure roller 10*a* and fixation roller 10*b* will be deformed by this pressure. Therefore, some image forming apparatuses are structured so that while their power source is off, or they are kept asleep for a substantial length of time, the pressure roller 10*a* is kept separated from the fixation roller 10*b*; the pressure reapplied when the next printing operation is started.

This embodiment is another example of application of the present invention, more specifically, the application of the present invention to a driving force transmitting portion which transmits driving force to a mechanism for separating the pressure roller 10*a* from the fixation roller 10*b*, or reapplying pressure to the pressure roller 10*a* to keep the pressure roller 10*a* upon the fixation roller 10*b*.

FIG. 22 is a perspective view of the driving force transmitting portion in this embodiment. Referring to FIG. 22, the driving force from a motor is transmitted first to a driving gear 60, which is the second gear. The driving gear 60 is such a driving gear that gives driving force by being driven by the motor. In this embodiment, it is a driving gear, as the second gear, which is driven by the motor. Choice of the second gear is not limited to the one in this embodiment. The second gear is a driving force transmitting gear which gives driving force. The driving gear is included in the choices of the driving force transmitting gears. The driving gear 60 gives driving force to a partially toothed gear 62 by meshing with the partially toothed gear 62, or the first gear. The driving gear 60 which receives driving force from the motor always rotates at a constant speed. The partially toothed gear 62, or the first gear, is such a driven gear that rotates by receiving driving force from the driving gear 60. Like the partially toothed gears in the first to the third embodiments, the partially toothed gear 62 is made up of a large gear 62, a small gear 62*b*, and a cam portion 62*c*, which are integral parts of the partially toothed gear 62 and rotate together. The large gear 62*a* has a toothless portion and a toothed portion. The detailed description of the partially toothed gear 62 is given later. As a solenoid 65 is activated, the partially toothed gear 62 begins to rotate. More specifically, as the large gear 62*a* rotates by receiving driving force from the driving gear 60, and therefore, the small gear 62*b* also rotates. Unlike an ordinary gear, the teeth of which are the same in shape, the large gear 62*a* has teeth 62*ah* and 62*ai* which are smaller than the other teeth of the large gear 62*a*. Further, the tooth 62*i* is smaller than the tooth 62*h*. Unlike the other teeth of the large gear 62*a*, which are the same in size and shape, these smaller teeth 62*ah* and 62*ai* are shaped and sized to decelerate the large gear 62*a*. As for the small gear 62*b*, it has a toothless portion 62*bj*. It is adjusted in the number of its teeth so that when the partially toothed gear 62 is remaining stationary, that is, when it is in its home position, the toothless protrusive portion 62*bj* fits in the toothless concave portions 63*j*1 and 63*j*2 of the driven gear 63. More concretely, as the small gear portion 62*b* rotates once, the driven gear 63 rotates ½ time. The driven gear 63 is the third gear, which rotates by receiving driving force from the partially toothed gear 62 by meshing with the partially toothed gear 62, or the second gear. The driven gear 63 is solidly fixed to a shaft 69 so that it rotates with the cam 66. Further, the driving force transmitting portion is structured so that the cam 66 can move the pressure roller shaft 10*a*1 by way of a lever 67. Further, the pressure roller shaft 10*a*1 is also the shaft of the unshown pressure roller 10*a*, and is under the pressure generated by a spring 68 in the direction of an unshown fixation roller 10*b*.

At this time, referring to parts (a) and (b) of FIG. 23, the operation of the driving force transmitting portion, and the movement of the pressure roller shaft 10*a*1, are described. Part (a) of FIG. 23 shows such a state of the driving force transmitting portion that the pressure roller shaft 10*a*1 is on the top side in its moving range and the pressure roller is under pressure. Part (b) of FIG. 23 shows such a state of the driving force transmitting portion that the pressure roller is on the bottom side of its moving range and the pressure roller is not under pressure. Part (a) of FIG. 23 in which the pressure roller is under pressure, and part (b) of FIG. 23 in which the pressure roller is not under pressure, are different by 180° in the rotational phase of the driven gear 63 and that of the cam portion 66. As described above, the driving force transmitting portion is structured so that a single full rotation of the driven gear 63 is equivalent to half the rotation of the driven gear 63. Therefore, each time the partially toothed gear 62 is rotated by a full turn, the driving force transmitting portion is switched in state between the one in which the pressure roller is under pressure and the one in which the pressure roller is not under pressure.

Further, the small gear portion 62*b* of the partially toothed gear 62 has the toothless protrusive portion 62*bj*, whereas the driven gear 63 has toothless recessive portions 63*j*1 and 63*j*2. When the driving force transmitting portion is not driven (partially tooth gear is in home position), the toothless protrusive portion 62*bj* of the small gear portion 63*j*1 is in the toothless recessive portion 63*j*1 or 63*j*2 of the driven gear 63. When the driving force transmitting portion is in this state, the driven gear 63 remains locked by the engagement between the toothless protrusive portion of the partially toothed gear 62 and the toothless recessive portion of the driven gear 63. Therefore, unless the driven gear 63 is subjected to a substantial amount of force, it is unlikely that the driven gear 63 rotates.

With the driving force transmitting portion being structured as described above, it is possible not only to switch the state of the driving force transmitting portion between the one in which the pressure roller is under pressure and the one in which the pressure roller is not under pressure, and also, to hold the pressure roller shaft 10*a*1 in the position in which it keeps the pressure roller under pressure, or the position in which it keep the pressure roller free from the pressure.

Next, referring to parts (a)-(e) of FIG. 24, the operation of the driving force transmitting portion in this embodiment is described in detail, along with what characterizes this embodiment, that is, a means to reduce an image forming apparatus (driving force transmitting portion) in the collisional noises it makes when it is started.

Parts (a)-(e) of FIG. 24 are drawings of only the driving force transmitting portion of an image forming apparatus (printer 90). They illustrate the sequential stages through which driving force is transmitted in the sheet feeding apparatus.

To begin with, part (a) of FIG. 24 is a side view of the driving force transmitting portion when the driving force transmitting portion is not in operation, that is, when the partially tooth gear is in its home position. When the driving force transmitting portion is in the state shown in part (a) of FIG. 24, the driving gear 60 faces the toothless portion of the large gear portion 62*a* of the partially toothed gear 62. Therefore, driving force is not transmitted to the partially toothed gear 62. Moreover, the partially toothed gear 62 is remaining pressed in the clockwise direction by the pressure lever 64. However, it is locked by the solenoid flapper 65*a*, being therefore, remaining stationary. Therefore, driven gear 63 also is remaining stationary.

Next, part (b) of FIG. 24 is a side view of the driving force transmitting portion immediately before the driven gear 63 begins to be driven. As the solenoid flapper 65*a* is pulled, the partially toothed geared 62 begins to be rotated in the clockwise direction by the pressure from the pressure lever 64. Thus, the toothed portion of the large gear 62*a* begins to mesh with the driving gear 60, and therefore, driving force begins to be transmitted from the large gear 62*a* to the partially toothed gear 62.

Next, part (c) of FIG. 24 is a side view of the driving force transmitting portion immediately before the driven gear 63 begins to be driven. As the first tooth 62*b* of the small gear portion 62*b* fits into the toothless recessed portion 63*j*1 of the driven gear 63, the driving of the driven gear 63 begins. In the case of a driving force transmitting portion which is not in accordance with the present invention, substantial noises are generated as the first tooth 62*bk* collides with the toothless recessed portion 63*j*1. In this embodiment, therefore, the large gear portion 62*a* is provided with the smaller gears 62*ah* and 62*ai* to decelerate the partially toothed gear 62 with such timing that the first tooth 62*bk* bumps into the toothless recessed portion 63*j*1. With the driving force transmitting portion being structured as described above, the first tooth 62*b* of the small gear portion 62*b* fits into the toothless recessed portion 63*i*1 of the driven gear 63 while the partially toothed geared 62 is decelerating. Therefore, the noises which the driving force transmitting portion in this embodiment generate as its first tooth fits into its toothless recess portion is significantly smaller than those generated by a conventional driving force transmitting portion. By the way, immediately after the fitting of the first tooth 62*b* into the toothless recessed portion 63*i*1, the driven gear 63 is accelerated by an amount equal to the amount by which it was decelerated. However, this acceleration of the driven gear 63 has little problematic effect upon the movement of the pressure roller; the movement of the pressure roller is no different from that in a conventional driving force transmitting portion. That is, the present invention can also be applied to the mechanism for moving the pressure roller, with no problem.

Further, the deceleration of the partially toothed gear by the teeth 62*ah* and 62*ai* in this embodiment is the same as that in the fourth embodiment described above. Therefore, it is not described here.

Next, part (d) of FIG. 24 is a side view of the driving force transmitting portion while the driving force transmitting portion is in operation. When the driving force transmitting portion is in operation, the toothed portion of the large gear portion 62*a*, and the toothed portion of the small gear portion 62*b*, are meshed with the driving gear 60 and driven gear 63, respectively, and therefore, the driving force transmitting portion functions as an ordinary driving force transmitting mechanism.

Lastly, part (e) of FIG. 24 is a side view of the driving force transmitting portion immediately before the partially toothed gear 62 is rotated back into its home position. As the meshing between the toothed portion of the large gear portion 62*a* and the driving gear 60 ends, the partially toothed gear 62 is rotated back into its home position by the pressure from the pressure lever 62. During this rotation of the partially toothed gear 62, the toothless protrusive portion 62*b* of the small gear portion 62*b* meshes with the toothless recessed portion 63*j*2 of the driven gear 63. Thus, the driven gear 63 is locked again.

As described above, by providing the partially toothed gear 62 with the small teeth 62*ah* and 62*ai*, it is possible to make the first tooth 62*bk* of the partially toothed gear 62 fit into the toothless recessed portion 63*j*1 with deceleration. Therefore, the driving force transmitting portion in this embodiment is significantly smaller in the amount of noises which occur when the tooth 62*bk* fits into the toothless recessed portion 63*j*1.

[Others]

In the embodiments described above, the driving force transmitting portion was structured so that only the first tooth, or one of the multiple tooth of the partially toothed gear, which is next to the toothless portion of the partially toothed gear was smaller than the other teeth of the partially toothed gear, and different in shape, or the three teeth of the partially toothed gear, which are next to the toothless portion of the driving force transmitting portion, are smaller than the other teeth of the partially toothed gear, and are different in shape from the other teeth. However, the embodiments are not intended to limit the present invention in scope in terms of the number of teeth of the partially toothed gear, which are smaller and different in shape from the normally sized and shaped teeth of the partially toothed gear. It may be set as necessary.

Also in the embodiments described above, the driving force transmitting portion was structured so that the first gear is a rotational partially toothed gear 27; the second gear which is rotated by meshing with the partially toothed gear 27 is the driven gear 30; and the partially toothed gear 27 has a tooth 27*a* shaped to decelerate the driven gear 30 with early timing. That is, the rotational first gear has the first tooth shaped to decelerate the second gear which is rotated by the first gear, with early timing. However, these embodiments are not intended to limit the present invention in scope in terms of the structure of a driving force transmitting portion. For example, a driving force transmitting portion may be structured so that the second tooth is the driving force transmitting tooth, and the first tooth which is rotated by the second tooth has the first tooth shaped to decelerate the first gear itself relative to the second gear, with early timing. This structural arrangement is briefly described with reference to FIG. 12.

Referring to FIG. 12, the driving gear 26, or the second gear, meshes with the first gear, is such a driving gear that meshes with the first gear and transmits driving force to the first gear by rotating. A driving gear which is driven by a motor belongs to a group of driving force transmitting gears. The partially toothed gear 27, or the first gear, has multiple teeth by which it meshes with the driving gear 26. It is such a driven gear that rotates by receiving driving force from the driving gear 26. It has a tooth 27*a*, which is one of the first teeth, is different in shape from the other teeth of the partially toothed gear 27. Here, the tooth 27*a*, or the first tooth of the partially toothed gear 27, is shaped to begin to decelerate the partially tooth gear with earlier timing than a gear structured so that all of its teeth are the same in shape.

Referring to FIG. 12, the tooth 27*a* of this partially toothed gear 27 has the surface 27*a*1 by which it contacts the tooth 26*a* of the driving gear 26. By the way, the surface 2*a*1 of this tooth 27*a* is the same in structure as the counterpart in the first embodiment, which was described with reference to part (b) of FIG. 3. Therefore, it is not described here.

Even if it is structured as described above, it can begin to decelerate with earlier timing than a comparative gear, the teeth of which are the same in shape. Therefore, it can prevent a sheet of recording medium from generating substantial noises (tensioning noise) when it is fed into the main assembly of an image forming apparatus (printer, for example), or can provide an image forming apparatus which does not suffer from the problem that banging noise is generated because a stack of sheets and/or sheet holding plate is made to float in the air by inertia.

Moreover, in the embodiments described above, the image forming apparatus was a printer. However, these embodiments are not intended to limit the present invention in scope in terms of the selection of image forming apparatuses to which the present invention is applicable. That is, the present invention is also applicable to other image forming apparatuses than a printer. For example, it is applicable to a copying machine, a facsimileing machine. Moreover, it is applicable to a multifunction image forming apparatus capable of functioning as any of the aforementioned image forming apparatuses. Application of the present invention to the driving force transmitting portion of the sheet conveying apparatus of any of these image forming apparatuses can provide effects similar to those described above.

Also in the embodiments described above, the sheet feeding apparatus was an integral part of the image forming apparatus. These embodiments, however, are not intended to limit the present invention in scope in terms of the selection of sheet feeding apparatus to which the present invention is applicable. That is, the present invention is also applicable to a sheet feeding apparatus which is removably mountable in the main assembly of an image forming apparatus. Application of the present invention to the driving force transmitting portion of such a sheet feeding apparatus can provide effects similar to those described above.

Further, in the embodiments described above, the sheet feeding apparatus was such a sheet feeding apparatus that feeds a sheet of recording medium such as recording paper, on which recording is made, into the main assembly of an image forming apparatus (printer). These embodiments, however, are not intended to limit the present invention in scope in terms of the selection of sheet feeding apparatus to which the present invention is applicable. For example, the present invention is also applicable to the driving force transmitting device of a sheet feeding apparatus for feeding a sheet of original or the like, which is an object to be read, into the main assembly of a reading apparatus. Application of the present invention to such a driving force transmitting portion can provide effects similar to those described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-203069 filed on Oct. 20, 2017 and 2018-131618 filed on Jul. 11, 2018, which are hereby incorporated by reference herein in their entirety.

What is claimed is:

1. An image forming apparatus for forming an image on a sheet, said apparatus comprising:

a sheet feeding device including a roller configured to feed the sheet;

a drive transmitting device configured to transmit a driving force to the roller of said sheet feeding device, the drive transmitting device comprising:

a first gear which is a partially toothed gear, the first gear including a first tooth and a second tooth, the first tooth being at least one of teeth of said first gear, and the second tooth being at least one of the teeth of said first gear, the second tooth being adjacent to the first tooth with respect to a rotational moving direction of said first gear, the second tooth being in front of the first tooth with respect to the rotational moving direction of said first gear; and a second gear configured to engage with said first gear;

wherein the first tooth has a tooth surface configured to contact said second gear, and the first tooth engages the second gear after the second tooth engages the second gear in a state where rotation of the first gear is continued, wherein when (i) a first contact point denotes a contact point between the first tooth and the second gear, (ii) a second contact point denotes a contact point between the second tooth and the second gear, and (iii) a first line of action denotes a line of action which is formed by movement of the second contact point with a rotation of the second gear, the first line of action is tangential to both a base circle of the first gear and a base circle of the second gear, said tooth surface has such a shape that the first contact point is in a region between the first line of action and the base circle of the first gear.

2. A drive transmitting device according to claim 1, wherein said first gear includes a region without a tooth, the region without the tooth is adjacent to the first tooth on an upstream side of the first tooth with respect to the rotational moving direction of said first gear.

3. A drive transmitting device according to claim 1, wherein said first gear includes a third tooth which has such a shape that a contact point of said third tooth of said first gear to said second gear is in a region of a first gear side with respect to the first line of action.

4. A drive transmitting device according to claim 1, wherein said first gear is a stepped gear including a first step gear portion engaged with said second gear and a second step gear portion engaged with a drive gear, wherein said first step gear portion and said second step gear portion include no-tooth regions, in the rotational moving direction, in which no tooth is provided engaged with said second gear portion and said drive gear, respectively wherein said device further comprises a locking member capable of locking and releasing said first gear at a position where the no-tooth regions of said first step gear portion and said second step gear portion oppose said second gear and said drive gear, and said device further comprising, rotational force applying means configured to apply to said first gear a rotational force for engaging a tooth of said first gear with said second gear and said drive gear.

5. A drive transmitting device according to claim 1, wherein the first tooth is configured to contact the second gear such that the first contact point is moved from a first point to a second point, the second point is further from the first line of action than the first point is.

6. A drive transmitting device according to claim 1, wherein said first gear is a drive transmission gear configured to transmit a driving force, and said second gear is a driven gear configured to be driven by a driving force received from said first gear through an engagement with said first gear.

7. A drive transmitting device according to claim 1, wherein said first gear is a driving gear configured to be rotated by receiving a driving force, and said second gear is a drive transmission gear configured to transmit the driving force to said first gear through the engagement with said first gear.

8. An image forming apparatus according to claim 1, wherein said sheet feeding device includes, stacking means configured to stack sheets;

first feeding means configured to feed a sheet from the sheets stacked on said stacking means; and second feeding means configured to feed the sheet fed out of said first feeding means, wherein said drive transmitting device is configured to transmit a driving force to said stacking means or said first feeding means.

9. A drive transmitting device according to claim 1, wherein the first tooth has a cross-sectional area which is smaller than that of the second tooth in a plane perpendicular to a rotational axis of said first gear.

10. A sheet feeding apparatus comprising:

stacking means configured to stack sheets;

first feeding means configured to feed a sheet from the sheets stacked on said stacking means;

second feeding means configured to feed the sheet fed out of said first feeding means; and a drive transmitting device configured to transmit a driving force to said stacking means or said first feeding means, the drive transmitting device comprising:

a first gear which is a partially toothed gear, the first gear including a first tooth and a second tooth, the first tooth being at least one of teeth of said first gear, and the second tooth being at least one of the teeth of said first gear, the second tooth being adjacent to the first tooth with respect to a rotational moving direction of said first gear, the second tooth being in front of the first tooth with respect to the rotational moving direction of said first gear; and a second gear configured to engage with said first gear;

wherein the first tooth has a tooth surface configured to contact said second gear, and the first tooth engages the second gear after the second tooth engages the second gear in a state where rotation of the first gear is continued, wherein when (i) a first contact point denotes a contact point between the first tooth and the second gear, (ii) a second contact point denotes a contact point between the second tooth and the second gear, and (iii) a first line of action denotes a line of action which is formed by movement of the second contact point with a rotation of the second gear, the first line of action is tangential to both a base circle of the first gear and a base circle of the second gear, said tooth surface has such a shape that the first contact point is in a region between the first line of action and the base circle of the first gear.

11. A sheet feeding apparatus according to claim 10, wherein said second gear of said drive transmitting device is operatively connected with said feeding means, and wherein a sheet feeding speed Vf of said first feeding means and a sheet feeding speed Vt of said second feeding means satisfy $Vf \geq Vt$.

12. A sheet feeding apparatus according to claim 10, further comprising a lift-up mechanism configured to raise said stacking means toward said first feeding means; and a one-way clutch configured to transmit a driving force to said lift-up mechanism, said one-way clutch being rotatable only in one direction to raise said stacking means, wherein said second gear of said drive transmitting device is operatively connected with said lift-up mechanism through said one-way clutch.

* * * * *